US010722928B2

(12) United States Patent
Kehoe et al.

(10) Patent No.: US 10,722,928 B2
(45) Date of Patent: Jul. 28, 2020

(54) DRAIN CLEANER

(71) Applicant: MILWAUKEE ELECTRIC TOOL CORPORATION, Brookfield, WI (US)

(72) Inventors: Sean T. Kehoe, Waukesha, WI (US); Ryan J. Denissen, Sussex, WI (US); Vasil Zhmendak, Milwaukee, WI (US); Charles K. Cooksey, Menomonee Falls, WI (US); Peter J. Davies, Milwaukee, WI (US); Jingyuan Liang, New Berlin, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 301 days.

(21) Appl. No.: 15/824,800

(22) Filed: Nov. 28, 2017

(65) Prior Publication Data

US 2018/0147612 A1 May 31, 2018

Related U.S. Application Data

(60) Provisional application No. 62/509,805, filed on May 23, 2017, provisional application No. 62/426,898, filed on Nov. 28, 2016.

(51) Int. Cl.

| | |
|---|---|
| ***B08B 9/04*** | (2006.01) |
| ***B08B 9/047*** | (2006.01) |
| ***B08B 9/045*** | (2006.01) |
| ***E03F 9/00*** | (2006.01) |

(52) U.S. Cl.

CPC ..... *B08B 9/047* (2013.01); *B08B 9/045* (2013.01); *E03F 9/005* (2013.01); *B65H 2701/3917* (2013.01)

(58) Field of Classification Search

CPC ..... B08B 9/047; B08B 9/045; B08B 9/04

See application file for complete search history.

(56) References Cited

U.S. PATENT DOCUMENTS

| | | | |
|---|---|---|---|
| 2,111,527 | A | 3/1938 | Blanc |
| 2,167,268 | A | 7/1939 | Sanger |
| 2,223,005 | A | 11/1940 | Kerber |

(Continued)

FOREIGN PATENT DOCUMENTS

| | | |
|---|---|---|
| GB | 1118126 | 6/1968 |
| WO | 2006112847 | 10/2006 |

OTHER PUBLICATIONS

International Search Report and Written Opinion for Application No. PCT/US2017/063501 dated Apr. 10, 2018, 11 pages.

(Continued)

*Primary Examiner* — Michael D Jennings

(74) *Attorney, Agent, or Firm* — Michael Best & Friedrich LLP

(57) ABSTRACT

A drain cleaner includes a base unit having a housing, a drive arrangement positioned within the housing, and a motor coupled to the drive arrangement and supported by the housing. The motor is operable to selectively drive the drive arrangement. The drain cleaner also includes a drum unit removably coupled to the base unit. The drum unit has a drum that engages the drive arrangement when the drum unit is coupled to the base unit to rotate the drum, and a cable stored within the drum and selectively extendable out of the drum and into a drain.

23 Claims, 23 Drawing Sheets

(56) References Cited

U.S. PATENT DOCUMENTS

| | | | | |
|---|---|---|---|---|
| 2,225,129 | A | 12/1940 | Osborn | |
| 2,267,493 | A | 12/1941 | Clotz | |
| 2,282,600 | A | 5/1942 | Blanc | |
| 2,291,253 | A | 7/1942 | Osborn | |
| 2,355,733 | A | 8/1944 | Johnson et al. | |
| 2,426,265 | A | 8/1947 | Gavin | |
| 2,468,490 | A | 4/1949 | Joseph | |
| 2,552,808 | A | 5/1951 | O'Brien | |
| 2,562,574 | A | 7/1951 | Poekert | |
| 2,610,807 | A | 9/1952 | O'Brien | |
| 2,730,740 | A | 1/1956 | O'Brien | |
| 2,926,372 | A | 3/1960 | O'Brien | |
| 2,955,307 | A | 10/1960 | Hunt | |
| 3,025,547 | A | 3/1962 | Ciaccio | |
| 3,075,217 | A | 1/1963 | Kollmann | |
| 3,086,234 | A | 4/1963 | Crane | |
| 3,159,861 | A | 12/1964 | Sarcone | |
| 3,162,878 | A | 12/1964 | Agostino | |
| 3,246,354 | A * | 4/1966 | Cooney | B08B 9/045 15/104.33 |
| 3,298,051 | A | 1/1967 | Ratliff | |
| 3,451,089 | A | 6/1969 | Carlson et al. | |
| 3,451,090 | A | 6/1969 | Presti et al. | |
| 3,605,158 | A * | 9/1971 | Cooney et al. | E03F 9/005 15/104.33 |
| 3,747,153 | A | 7/1973 | O'Neill | |
| 3,897,602 | A | 8/1975 | Waterbury | |
| 3,928,885 | A | 12/1975 | Peterson et al. | |
| 3,950,934 | A | 4/1976 | Irwin | |
| 3,958,293 | A | 5/1976 | Irwin | |
| 4,104,757 | A | 8/1978 | Silverman | |
| 4,153,966 | A | 5/1979 | Irwin | |
| 4,188,683 | A | 2/1980 | Klunder | |
| 4,218,802 | A | 8/1980 | Babb et al. | |
| 4,284,931 | A | 8/1981 | Ehret | |
| 4,290,162 | A | 9/1981 | Agostino | |
| 4,364,139 | A | 12/1982 | Babb et al. | |
| 4,420,852 | A | 12/1983 | Bowlsby | |
| 4,464,806 | A | 8/1984 | Prange | |
| 4,570,281 | A | 2/1986 | Boelens | |
| 4,580,306 | A | 4/1986 | Irwin | |
| 4,611,360 | A | 9/1986 | Irwin | |
| 4,686,732 | A | 8/1987 | Irwin | |
| 4,700,422 | A | 10/1987 | Russell | |
| 4,716,613 | A | 1/1988 | Irwin | |
| 4,773,113 | A | 9/1988 | Russell | |
| 4,914,775 | A | 4/1990 | Kirk | |
| 4,916,772 | A | 4/1990 | Russell et al. | |
| 5,031,263 | A | 7/1991 | Babb et al. | |
| 5,031,276 | A * | 7/1991 | Babb | B08B 9/045 15/104.31 |
| 5,199,129 | A | 4/1993 | Salecker et al. | |
| 5,222,270 | A | 6/1993 | Sloter et al. | |
| 5,309,595 | A | 5/1994 | Salecker et al. | |
| 5,390,389 | A | 2/1995 | Rutkowski et al. | |
| 5,636,403 | A * | 6/1997 | Grimsley | B08B 9/045 15/104.095 |
| 5,657,505 | A | 8/1997 | Gallagher et al. | |
| 6,009,588 | A | 1/2000 | Rutkowski | |
| 6,243,905 | B1 | 6/2001 | Rutkowski | |
| 6,343,398 | B1 | 2/2002 | Silverman et al. | |
| 6,381,798 | B1 | 5/2002 | Rutkowski et al. | |
| 6,412,136 | B1 | 7/2002 | Rutkowski | |
| 6,546,582 | B2 | 4/2003 | Silverman | |
| 6,594,849 | B1 | 7/2003 | Nimens | |
| 6,618,892 | B2 | 9/2003 | Schmitt | |
| 6,760,948 | B2 | 7/2004 | Schmitt | |
| 7,073,224 | B2 | 7/2006 | Schmitt | |
| 7,222,383 | B2 | 5/2007 | Hale | |
| 7,269,874 | B2 | 9/2007 | Hung | |
| 7,676,879 | B1 | 3/2010 | Rutenberg et al. | |
| 7,757,332 | B1 | 7/2010 | Hale | |
| 7,810,203 | B2 | 10/2010 | Stoltz | |
| 7,889,980 | B2 * | 2/2011 | Sooy | B08B 9/04 15/104.33 |
| 7,891,038 | B2 | 2/2011 | Hale | |
| 7,935,192 | B2 * | 5/2011 | Silverman | B08B 9/045 134/18 |
| 8,046,862 | B2 | 11/2011 | Eisermann et al. | |
| 8,176,593 | B2 | 5/2012 | Gress et al. | |
| 8,413,347 | B2 | 4/2013 | Gress et al. | |
| 8,615,837 | B2 | 12/2013 | Hale et al. | |
| 8,931,131 | B1 | 1/2015 | Feduke | |
| 9,009,906 | B2 | 4/2015 | Hale et al. | |
| 9,015,890 | B1 | 4/2015 | Owens | |
| 2004/0255415 | A1 | 12/2004 | Silva | |
| 2005/0193509 | A1 | 9/2005 | Rutkowski et al. | |
| 2007/0033752 | A1 | 2/2007 | Hung | |
| 2008/0098544 | A1 | 5/2008 | Rutkowski et al. | |
| 2009/0211044 | A1 * | 8/2009 | Hale | B08B 9/045 15/104.33 |
| 2010/0017981 | A1 * | 1/2010 | Hamm | B08B 9/043 15/104.33 |
| 2010/0050350 | A1 | 3/2010 | Babb et al. | |
| 2010/0139696 | A1 * | 6/2010 | Silverman | B08B 9/045 134/22.11 |
| 2014/0230181 | A1 * | 8/2014 | Yamaoka | E01H 1/0809 15/344 |
| 2016/0175899 | A1 | 6/2016 | Dunkin et al. | |
| 2018/0016776 | A1 * | 1/2018 | Stoneback | E03F 9/005 |
| 2018/0057385 | A1 * | 3/2018 | Bray, III | C02F 1/14 |

OTHER PUBLICATIONS

European Patent Office Extended Search Report for Application No. 17873949.6 dated Sep. 18, 2019 (10 pages).

* cited by examiner

DRAIN CLEANER

CROSS-REFERENCE TO RELATED APPLICATIONS

The present application claims priority to U.S. Provisional Patent Application No. 62/426,898, filed Nov. 28, 2016, and to U.S. Provisional Patent Application No. 62/509,805, filed May 23, 2017, the entire contents of both of which are incorporated by reference herein.

BACKGROUND

The present invention relates to drain cleaners.

Drain cleaners are used to clear clogs and other debris out of drains and other types of conduits. A drain cleaner typically includes an elongated cable that can be inserted into a drain. The cable may be rotated, or spun, to help break up clogs within the drain. More recent drain cleaners include motors to help spin the cables. These drain cleaners, however, may be relatively heavy and/or bulky, making them difficult to transport.

SUMMARY

In one embodiment, the invention provides a drain cleaner including a base unit having a housing, a drive arrangement positioned within the housing, and a motor coupled to the drive arrangement and supported by the housing. The motor is operable to selectively drive the drive arrangement. The drain cleaner also includes a drum unit removably coupled to the base unit. The drum unit includes a drum that engages the drive arrangement when the drum unit is coupled to the base unit to rotate the drum, and a cable stored within the drum and selectively extendable out of the drum and into a drain.

In another embodiment, the invention provides a base unit including a housing defining a vertical slot, a motor supported by the housing and having an output shaft, and a drive arrangement having a drive pulley coupled to the output shaft of the motor, an idler pulley supported by the housing, and a belt wrapped around the drive pulley and the idler pulley and extending across the vertical slot. The base unit also includes a drum unit removably coupled to the base unit. The drum unit includes a drum and a pulley coupled to the drum. The pulley is removably received in the vertical slot to engage the belt. The drum unit also includes a cable stored within the drum and selectively extendable out of the drum and into a drain.

In yet another embodiment, the invention provides a drain cleaner including a base unit having a housing defining a vertical slot, a strap arrangement coupled to the housing, a motor supported by the housing and having an output shaft, a battery pack supported by the housing and operable to provide power to the motor, and a drive arrangement having a drive pulley coupled to the output shaft of the motor, an idler pulley supported by the housing, and a belt wrapped around the drive pulley and the idler pulley and extending across the vertical slot. The base unit also includes a stabilizer configured to support the base unit in an upright position. The stabilizer is movable between a first position, in which the stabilizer is retracted relative to the housing, and a second position, in which the stabilizer extends outward relative to the housing. The drain cleaner also includes a drum unit removably coupled to the base unit. The drum unit includes an outer casing, a handle coupled to the outer casing, an inner drum rotatable within the outer casing, a shaft coupled to the inner drum and extending out of the outer casing, and a pulley coupled to an end of the shaft. The pulley is removably received in the vertical slot to engage the belt. The drum unit also includes a cable stored within the drum and selectively extendable out of the drum and into a drain. The strap arrangement is configured to be worn by a user and the handle is configured to be held by the user to separately carry the base unit and the drum unit.

Other aspects of the invention will become apparent by consideration of the detailed description and accompanying drawings.

Figure 2:
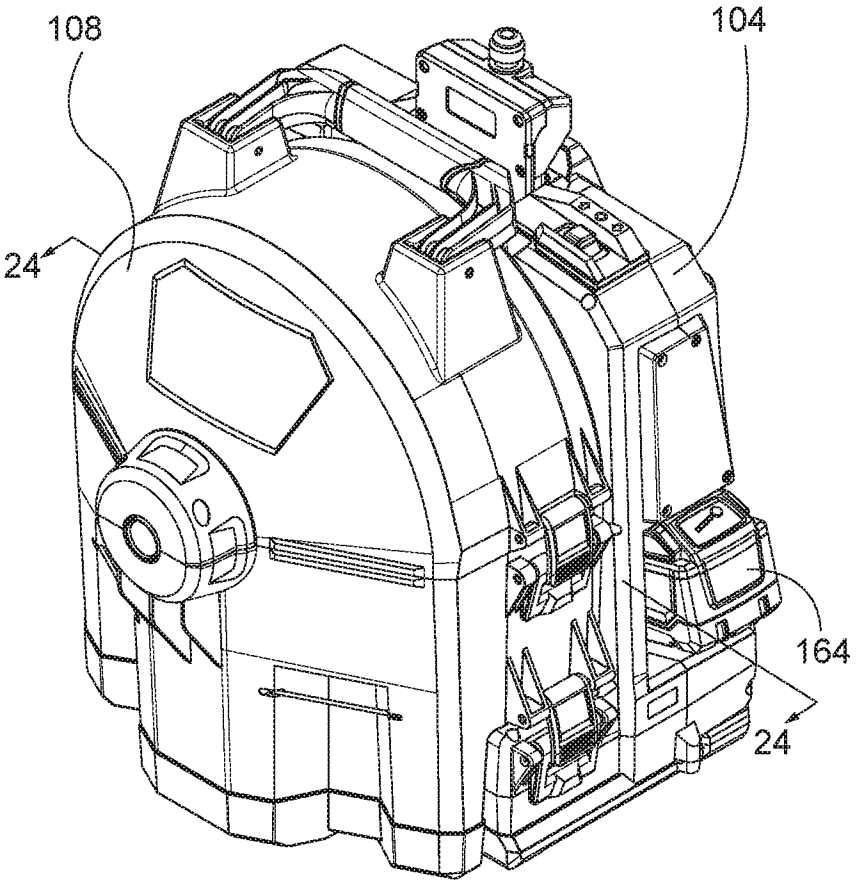
FIG. 2 is another perspective view of the drain cleaner shown in FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-5 illustrate a drain cleaner 100 including a first unit 104 and a second unit 108. The first unit 104 is a base unit or drive unit. The second unit 108 is a drum unit. The drain cleaner 100 is modular such that the second unit 108 is removable from the first unit 104. The first unit 104 includes a motor, a battery pack 164, and a stand portion or stabilizer. Although not shown in these figures, the first unit 104 can also include backpack-style straps. The second unit 108 is removable from the first unit 104 and includes a contained cable drum. In one embodiment, the drum can be dropped into place to interface with the motor and be rotated by the motor, e.g., moved solely in the vertical direction relative to the first unit 104 to interface the second unit 108 with the first unit 104 such that the drum can be rotated by the first unit 104. The drum can also be carried separately from the motor, the battery 164, and the stand portion to provide easier, more manageable carrying of the heavy drain cleaner 100 by a user. For example, the user can distribute the weight of the drain cleaner 100 between the drum carried in the user's hands and the first unit 104 carried on the user's back using the backpack straps. Additionally, various different drums, e.g., containing different sizes, lengths, types, etc. of cables can be attached to the same first unit. Thus, the first unit 104 can be used to drive various different drums containing various different cables.

Figure 1:
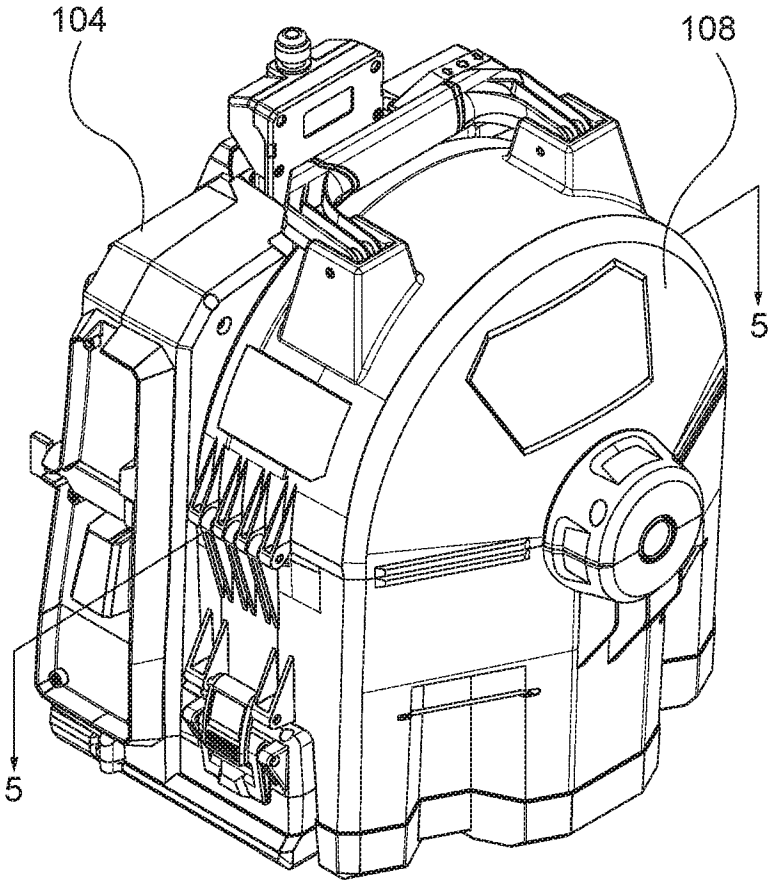
FIG. 1 is a perspective view of a drain cleaner including a base unit and a drum unit.
Figure 3:
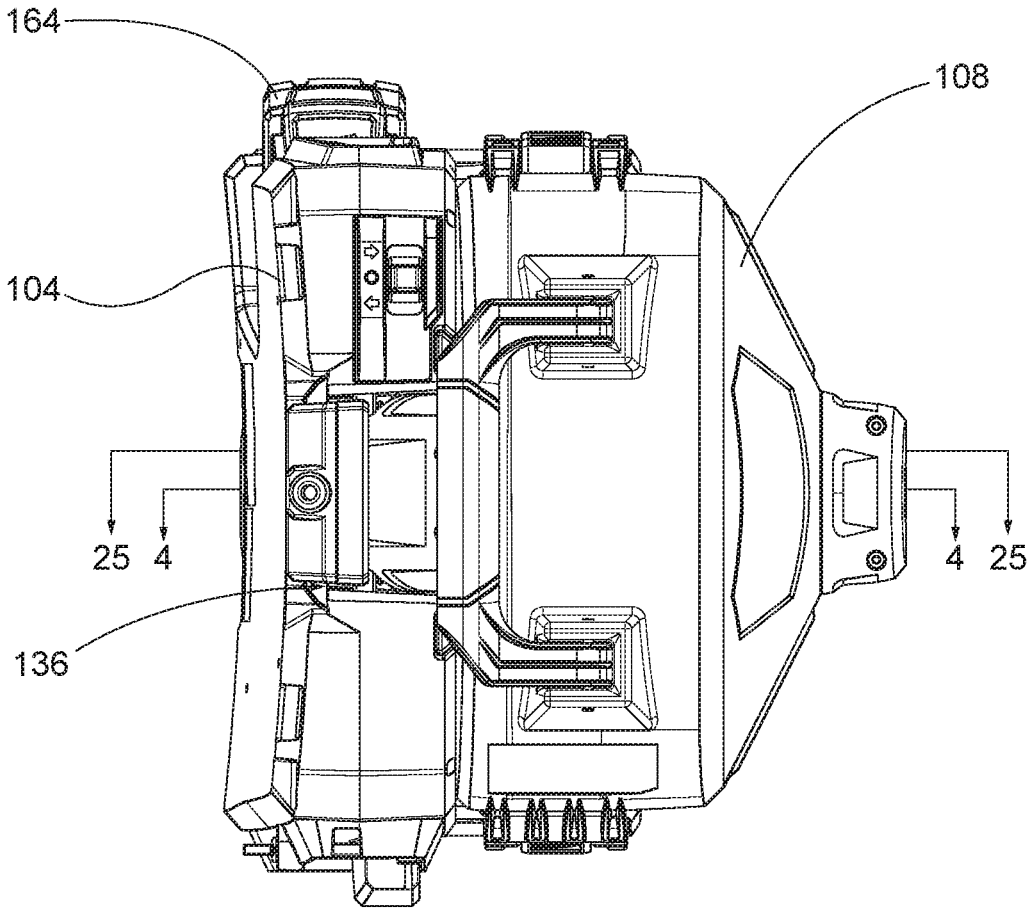
FIG. 3 is a top view of the drain cleaner shown in FIG. 1.
Figure 5:
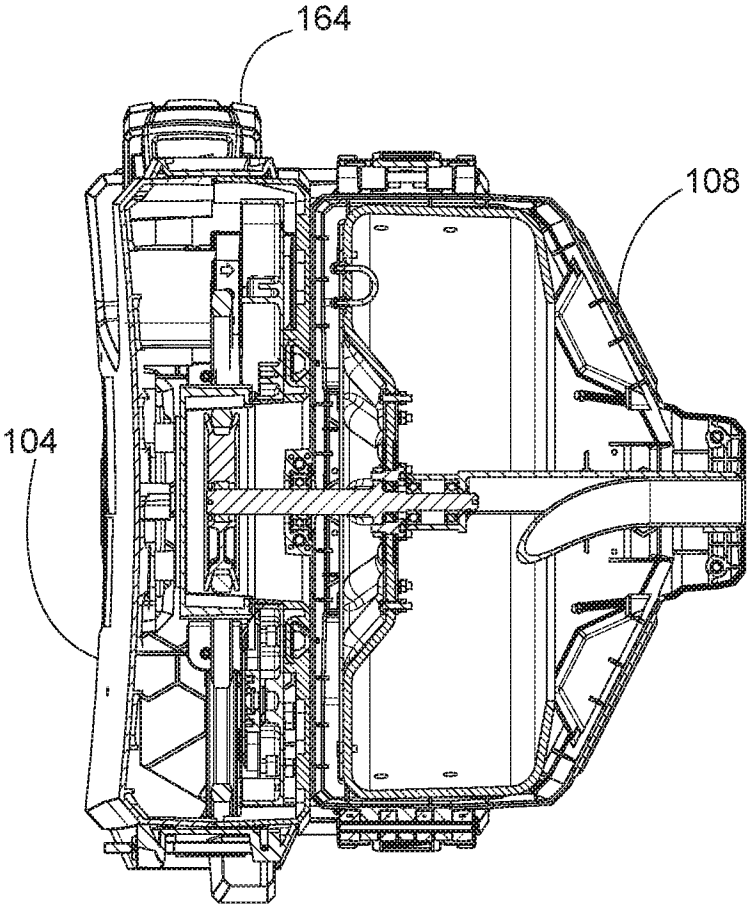
FIG. 5 is a cross-sectional view of the drain cleaner taken along section line 5-5 of FIG. 1.
Figure 4:
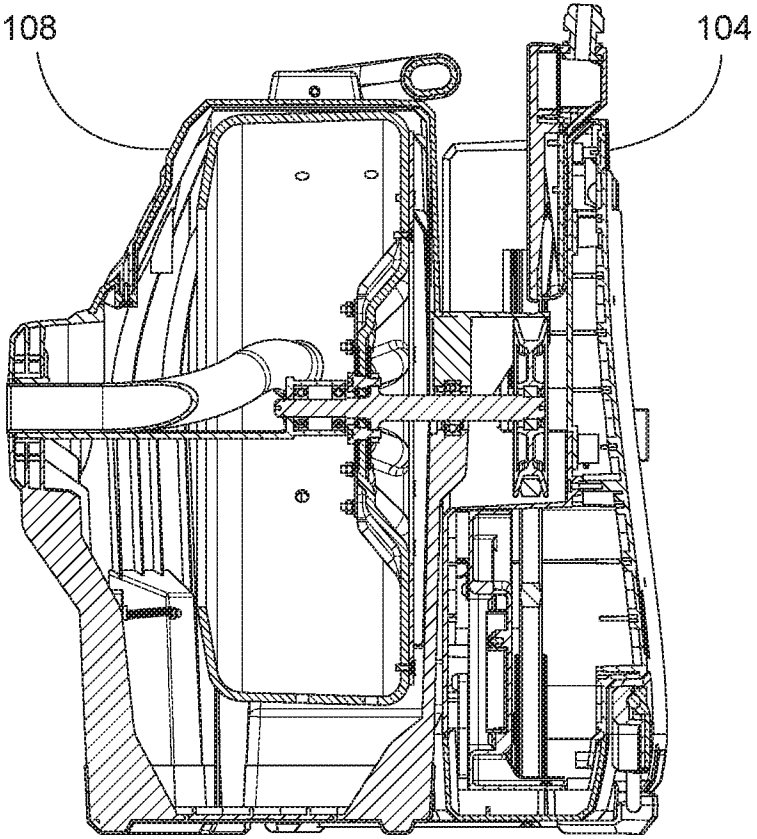
FIG. 4 is a cross-sectional view of the drain cleaner taken along section line 4-4 of FIG. 3.
Figure 7:
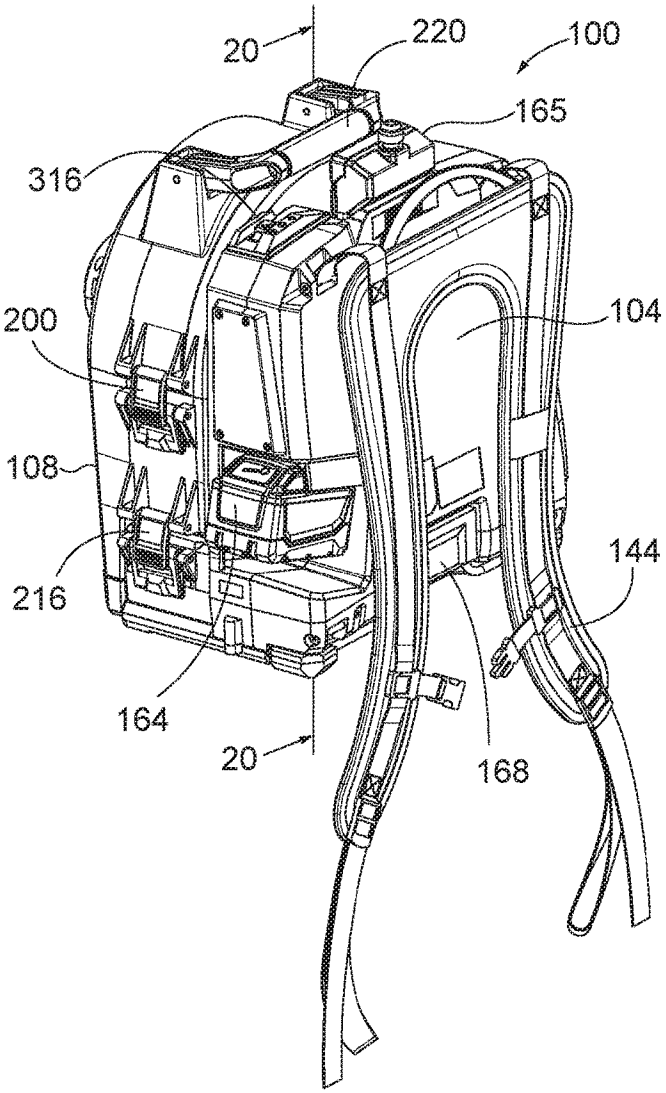
FIG. 7 is a rear perspective view of the drain cleaner shown in FIG. 6.
Figure 6:
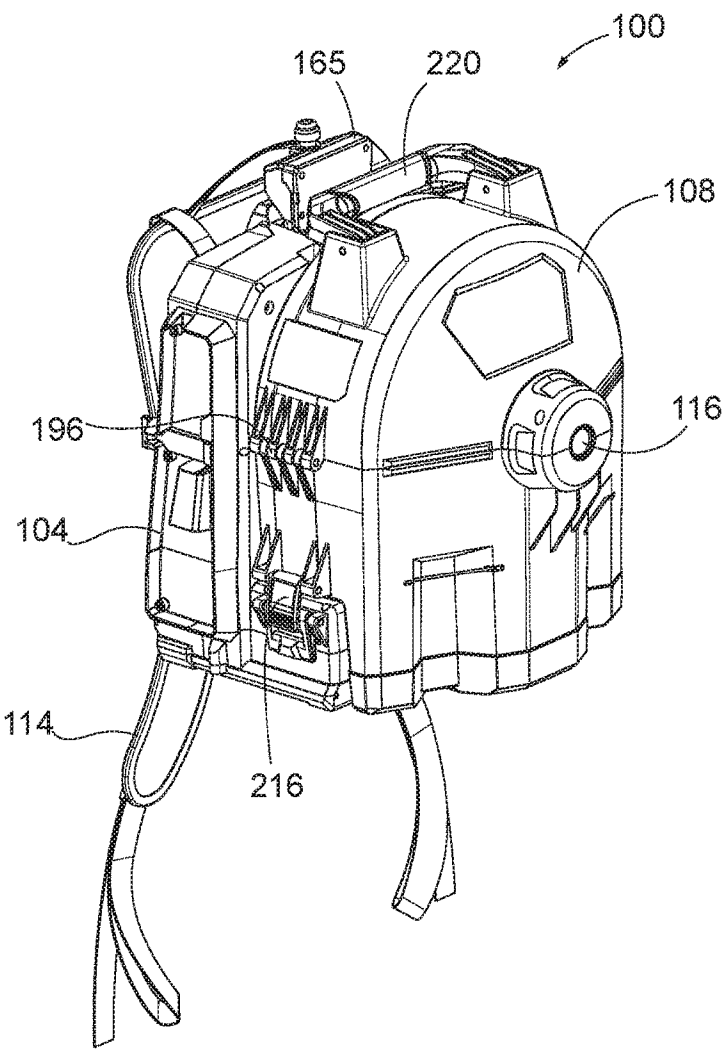
FIG. 6 is a front perspective view of the drain cleaner including a strap arrangement.
Figure 9:
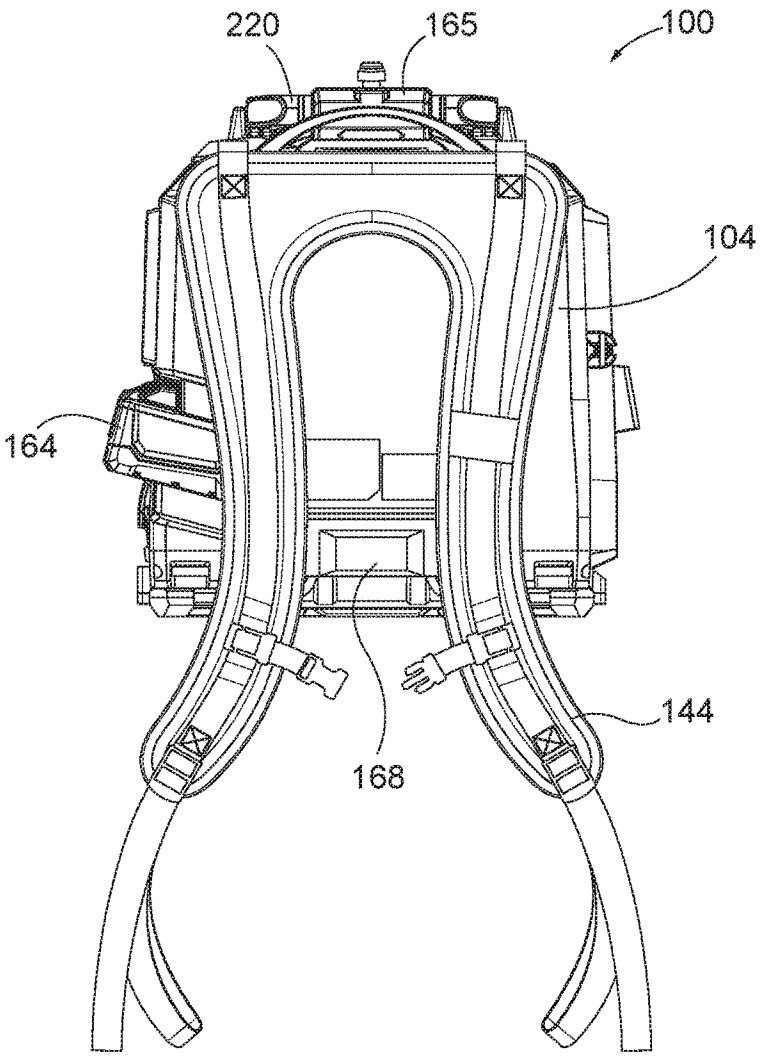
FIG. 9 is a rear view of the drain cleaner shown in FIG. 6.
Figure 8:
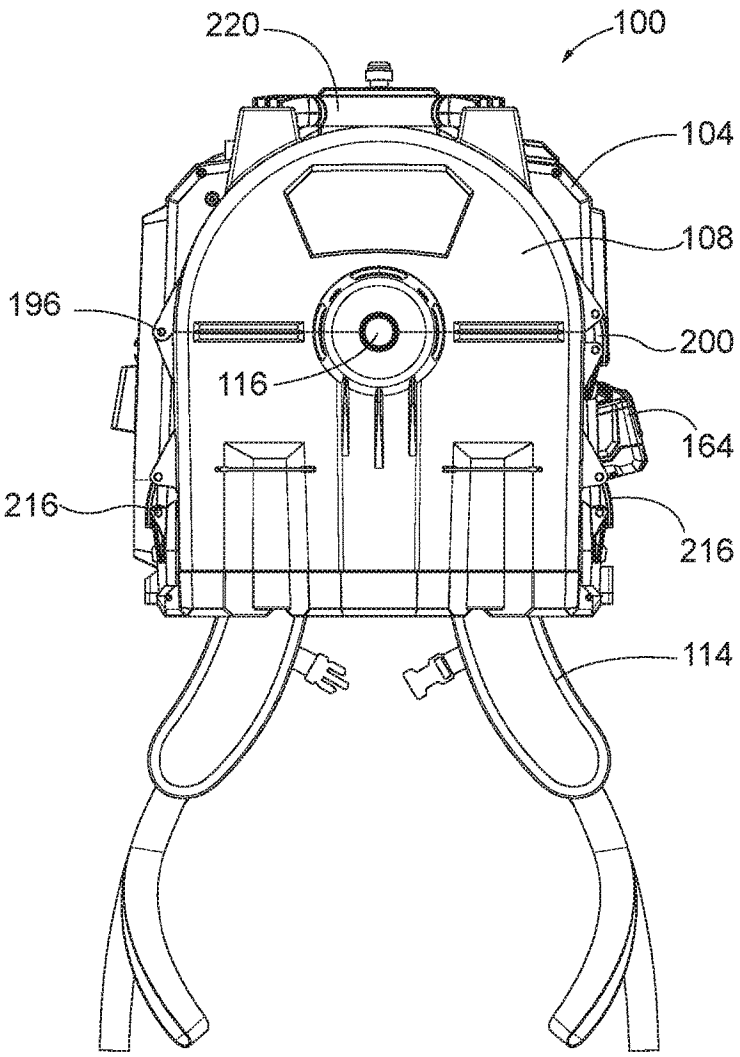
FIG. 8 is a front view of the drain cleaner shown in FIG. 6.

The drum of FIGS. 1 and 2 contains a cable. When a user reaches an end of the cable (e.g., all of the cable has been fed out of the drum), often times the user will swap in a new drum with more cable, attach an end of the new cable to the end of the old cable, and continue feeding cable down a drain. However, during this transition, the user does not want the free end of the old cable to escape down the drain. In some embodiments, drain cleaner includes a retention mechanism (e.g., a hook, a magnet, etc.) either on an exterior of the drum or on the driving unit. The retention mechanism is configured to retain (e.g., temporarily hold) the end of the old cable while the user changes the drum and the user is ready to connect the end of the old cable to the end of the new cable.

Figure 11:
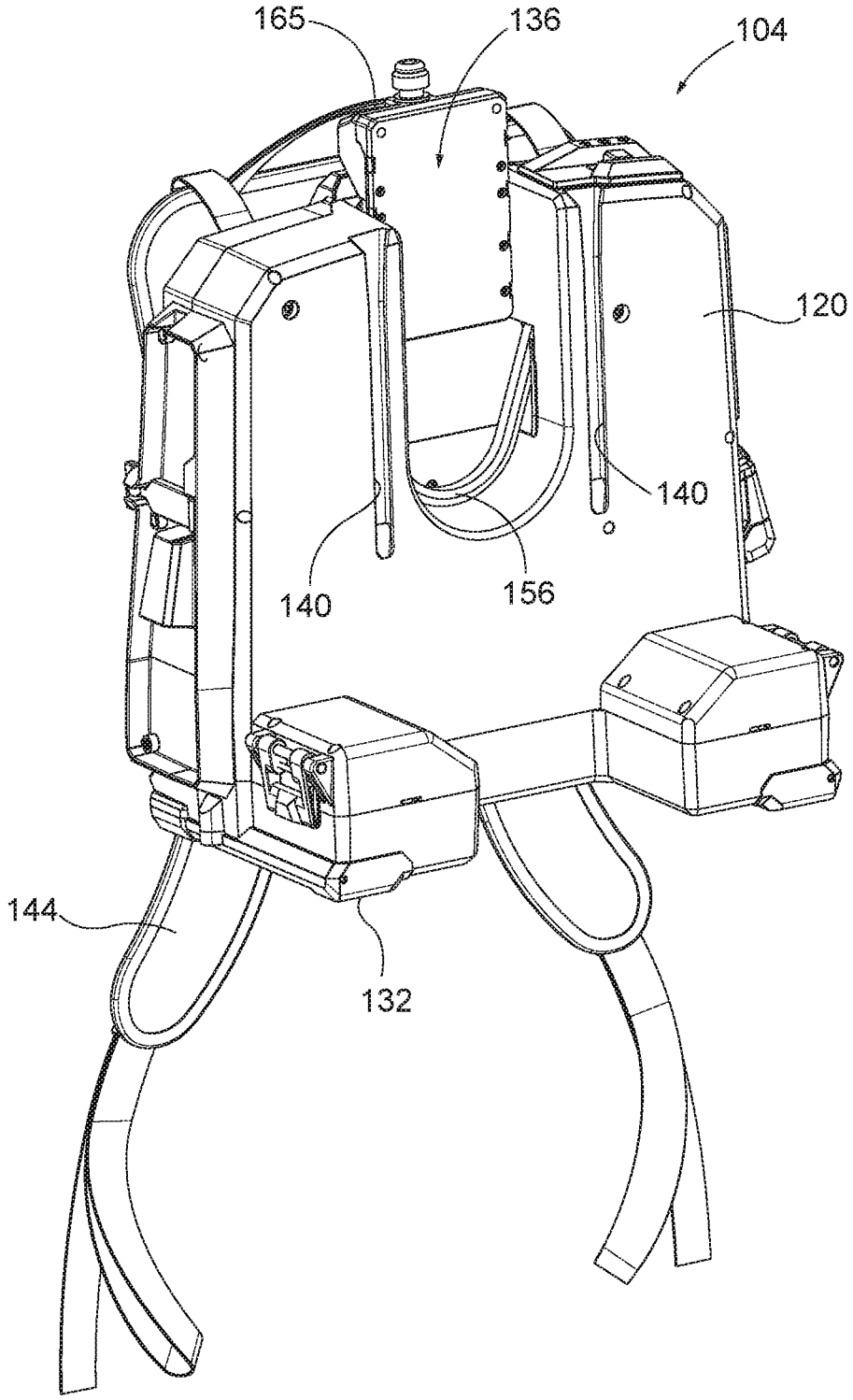
FIG. 11 is a front perspective view of a base unit of the drain cleaner shown in FIG. 6.

FIG. 11 illustrates the drive unit 104 of a drain cleaner 100. The drive unit 104 includes a vertical slot 136 configured to receive a portion of a drum that is driven by the drive unit 104 to spin a cable. In the illustrated embodiment, the drive unit 104 includes a belt and pulley system. A driven shaft of the drum is driven by an exterior surface of the belt. This arrangement allows for easy attachment and removal of the drum from the drive unit 104 (e.g., through a simple vertical sliding motion), without disassembling the drive unit 104, removing the belt, etc. Additionally, the relatively low locations of the drive wheel and the motor allows for the weight of the motor to be distributed below an axis of rotation of the drum, providing a stable base for the drive unit 104 and the drum.

In some embodiments, the drive unit 104 of the drain cleaner 100 may be controlled by a foot pedal 165. The illustrated drive unit 104 may be activated by an electronic foot pedal 165 that is electrically coupled to a controller of the motor 170. The electronic foot pedal 165 allows for superior control and guaranteed actuation compared to conventional foot pedals with air switches. In addition, the electronic foot pedal 165 allows for variable speeds, is fully sealed for water resistance, and includes a quick-connect cord for serviceability and storage advantages. For example, the foot pedal 165 may allow the drain cleaner 100 to operate at multiple speeds between zero speed (i.e., off or stopped) and full speed. In other embodiments, the foot pedal 165 may not be variable speed, but may simply turn the drain cleaner 100 on and off.

The motor of the drain cleaner 100 may also include an electronic brake to slow rotation of the drum when a user releases (e.g., takes his/her foot off of) the foot pedal 165. Electronic components (not shown) associated with the motor may also provide a breaking force to slow the rotation of the drum. The electronic brake is a soft-style brake that gradually stops rotation of the drum, rather than suddenly stopping rotation of the drum when the foot pedal 165 is released.

Figure 18:
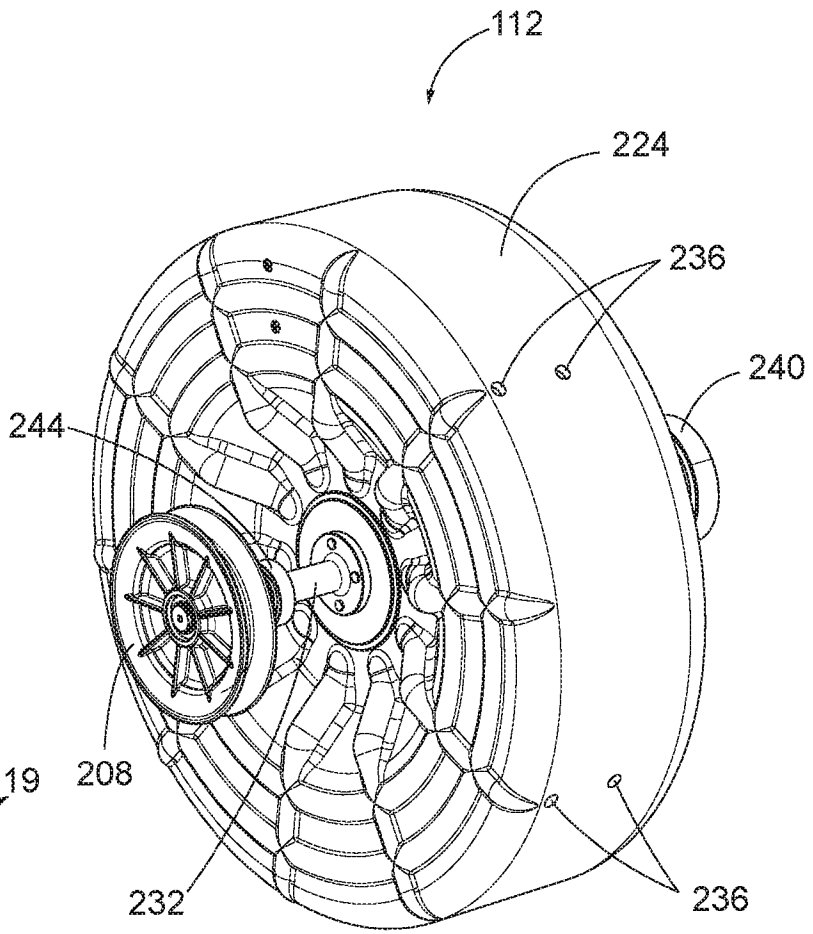
FIG. 18 is a rear perspective view of the inner drum of FIG. 17.
Figure 17:
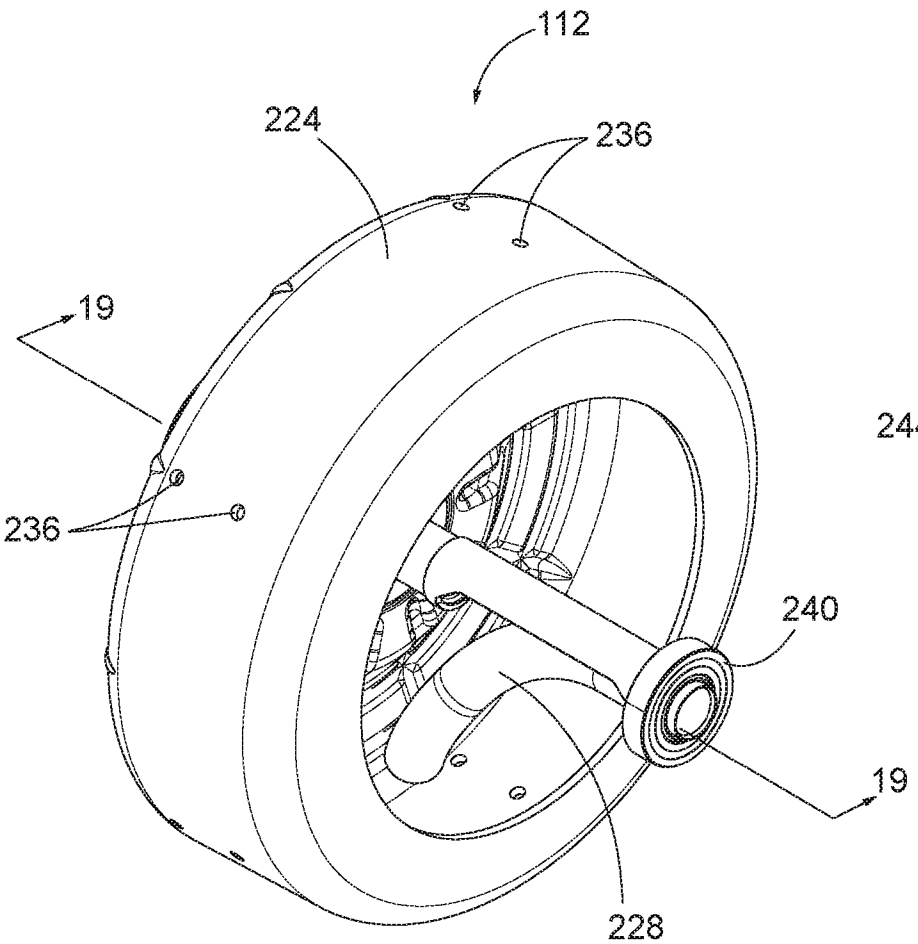
FIG. 17 is a front perspective view of an inner drum of the drain cleaner shown in FIG. 6.

FIGS. 6-9 illustrate the drain cleaner 100 in more detail. The drain cleaner 100 is configured to rest on the ground and remain upright during operation. The illustrated drain cleaner 100 includes a base unit 104, an outer casing or an outer drum 108, and an inner drum 112 (FIGS. 17-18). The base unit 104 supports the outer drum 108 and the inner drum 112 on the ground. The inner drum 112 is supported within the outer drum 108, and the outer drum 108 is removable with the inner drum 112 from the base unit 104. The inner drum 112 houses a flexible cable, or spring, which can be fed out of the drain cleaner 100 through an opening 116 in the outer drum 108 and into a drain. The base unit 104 is coupled to the inner drum 112 to rotate the inner drum 112 and, thereby, the flexible cable.

Figure 10:
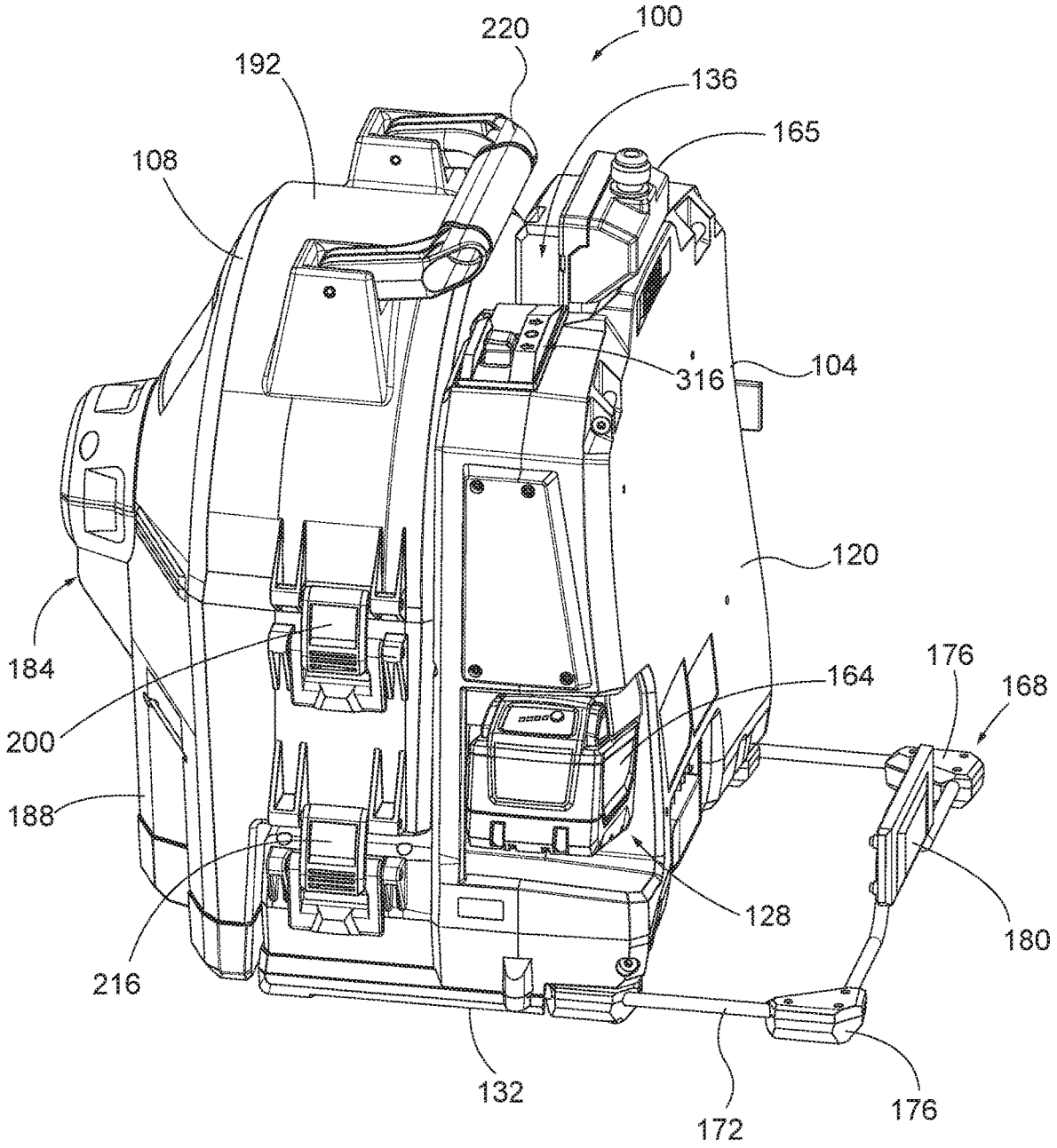
FIG. 10 is a perspective view of the drain cleaner shown in FIG. 6 including a stabilizer in an extended position.
Figure 12:
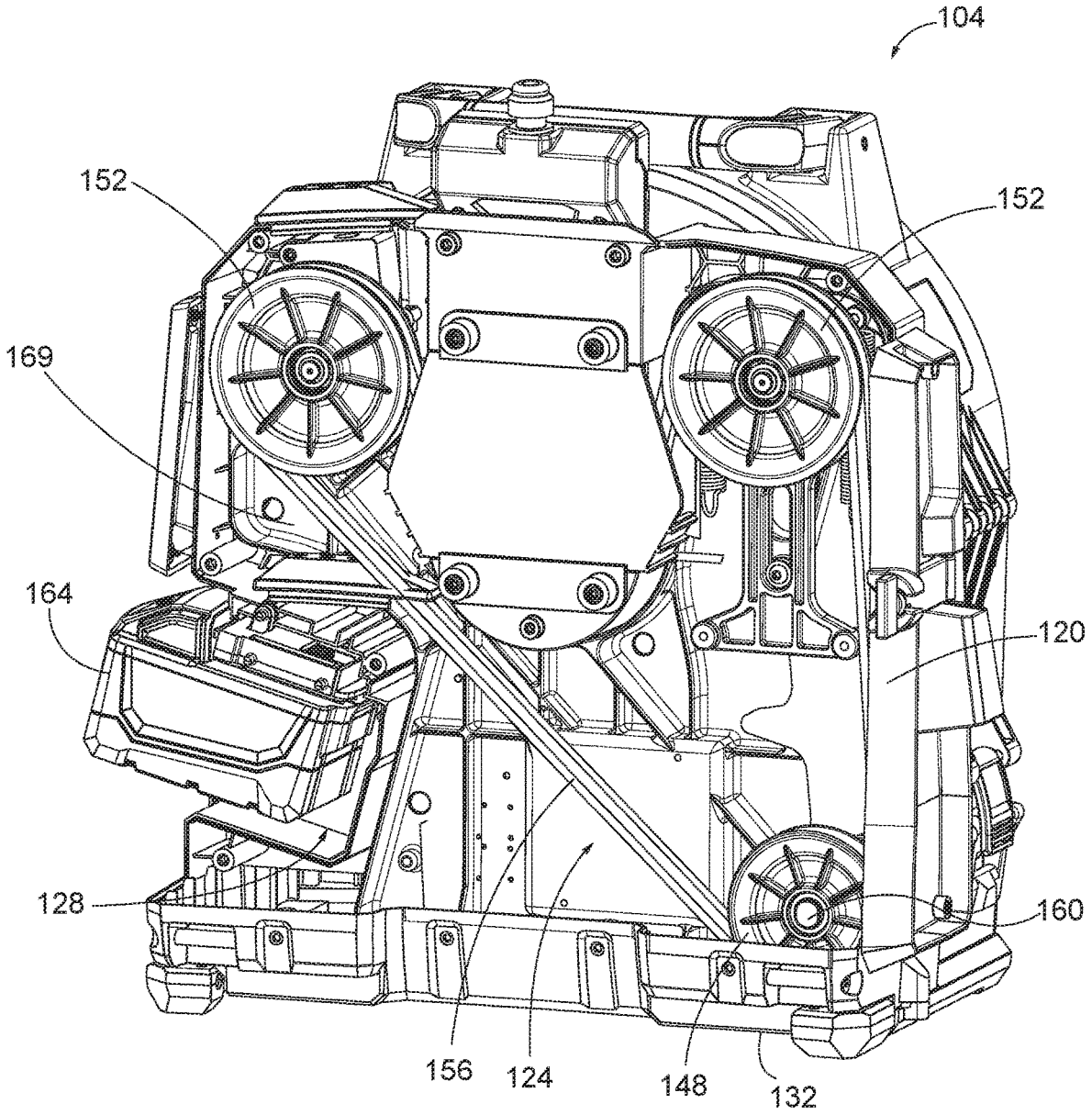
FIG. 12 is a rear view of the base unit of FIG. 11 with a portion of a housing removed to show a belt drive arrangement inside the base unit.

As shown in FIGS. 10-12, the illustrated base unit 104 includes a housing 120, a drive arrangement 124 positioned within the housing 120, and a battery receptacle 128 supported by the housing 120. The housing 120 includes a lower surface 132 that defines a base of the drain cleaner 100. As shown in FIG. 11, the illustrated housing 120 further includes a relatively large vertical slot 136 and two smaller guide slots 140. The large vertical slot 136 receives a portion of the inner drum 112 to operatively couple the inner drum 112 to the base unit 104, as described below. The guide slots 140 receive portions of the outer drum 108 to help align the outer and inner drums 108, 112 on the base unit 104.

Figure 11B:
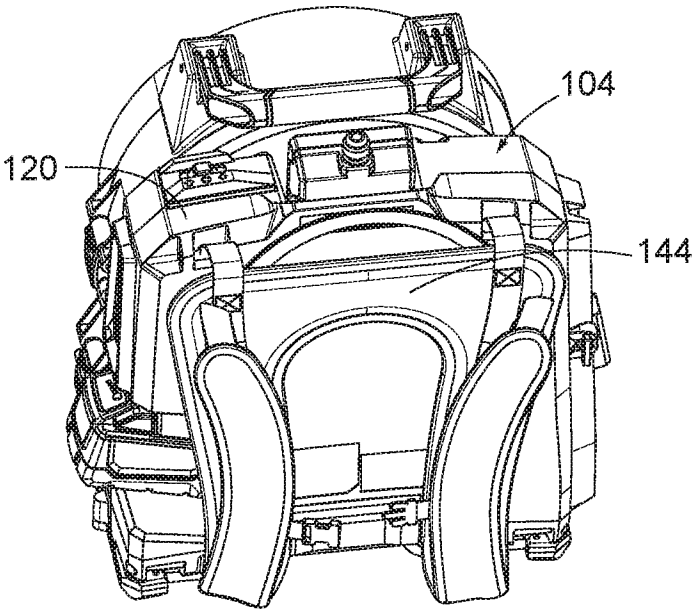
FIG. 11B is a rear view of the base unit shown in FIG. 11 with the strap arrangement in a raised position.
Figure 11A:
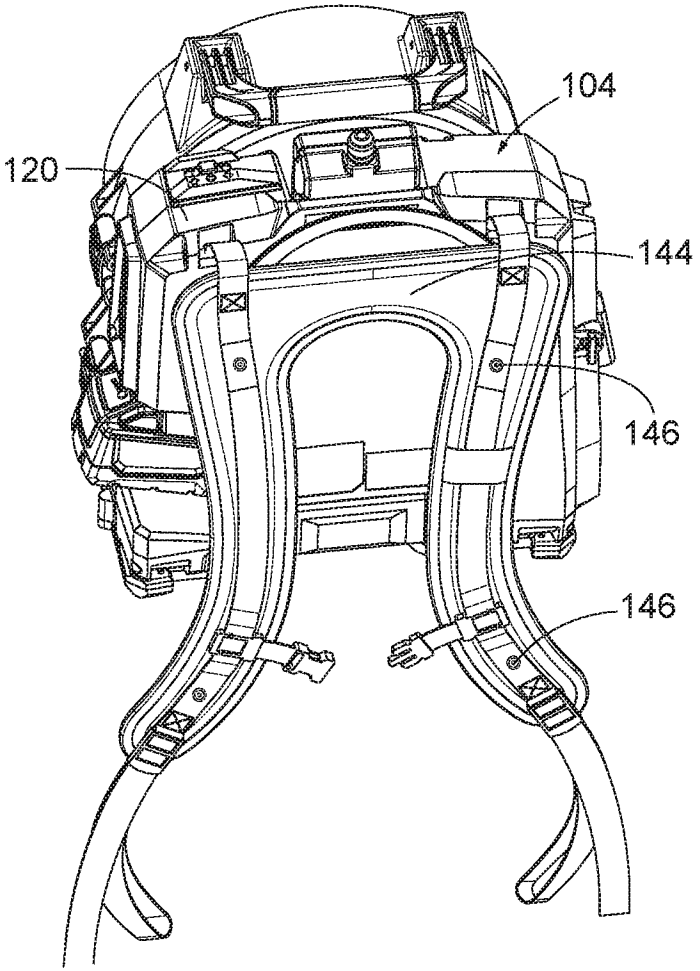
FIG. 11A is a rear view of the base unit shown in FIG. 11 with a strap arrangement in a lowered position.

In the illustrated embodiment, the base unit 104 also includes a strap arrangement 144 coupled to the housing 120 so that the drain cleaner 100 can be carried like a backpack. As shown in FIGS. 11A-11B, in some embodiments, the strap arrangement 144 may include snaps 146, or other coupling mechanisms, coupled near a top and a bottom of each strap. In such embodiments, the snaps 146 may couple together to lift lower portions of each strap away from the ground (as shown in FIG. 11B) and, thereby, out of any mess that may be on the floor of a jobsite. In other embodiments, the strap arrangement 144 may be omitted.

Figure 24:
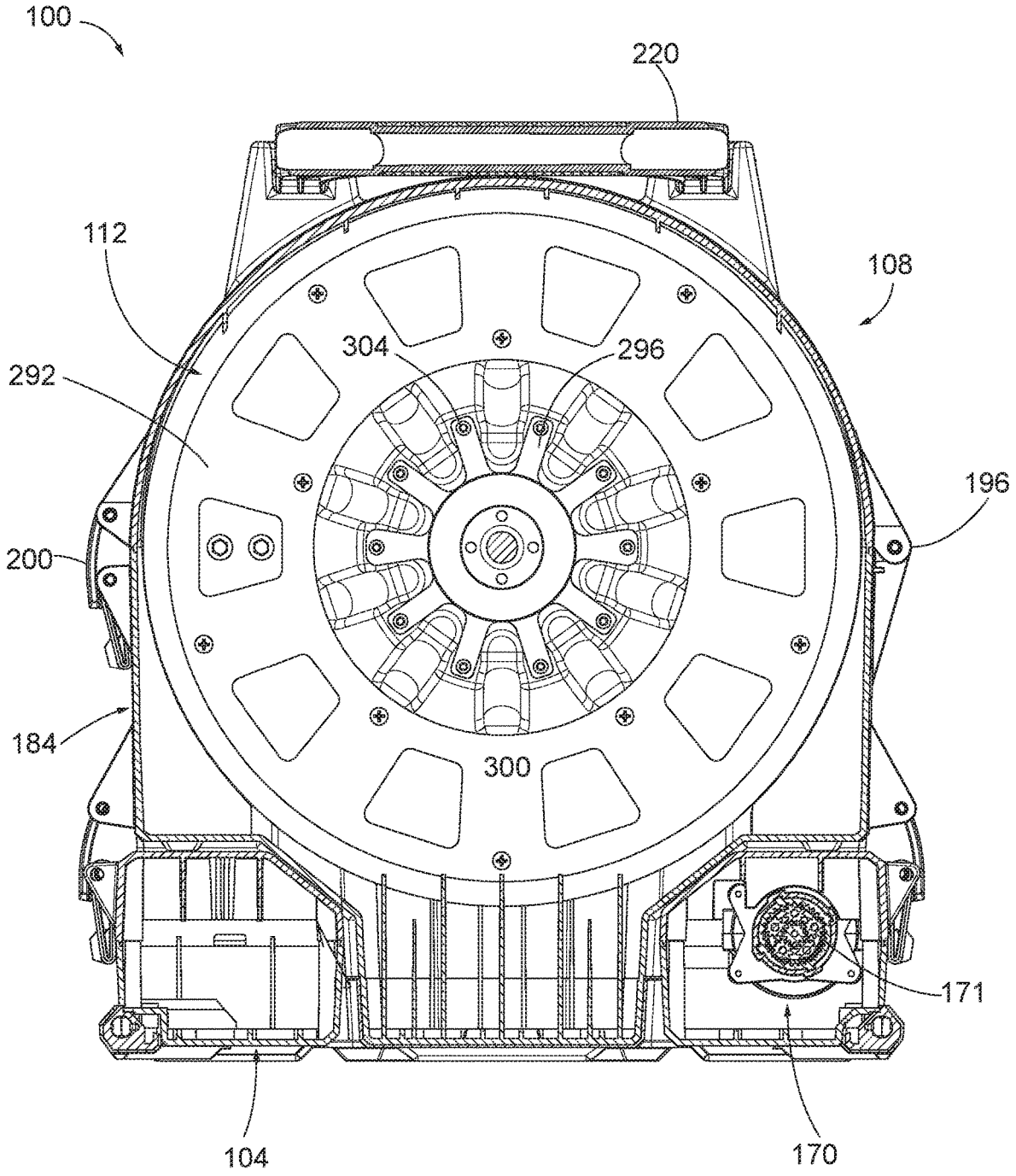
FIG. 24 is a cross-sectional view of the drain cleaner taken along section line 24-24 of FIG. 2.

As shown in FIG. 12, the illustrated drive arrangement 124 is a belt drive arrangement including a drive pulley 148, two idler pulleys 152, and a belt 156. The drive pulley 148 is coupled to an output shaft 160 of a motor 170 (FIG. 24). The idler pulleys 152 are supported by a mounting plate or backbone 169 of the housing 120 and are spaced apart from the drive pulley 156. In the illustrated embodiment, each idler pulley 152 is positioned on one side of the vertical slot 136 (FIG. 11). The belt 156 wraps around the pulleys 148, 152 and is driven by the drive pulley 148. As shown in FIG. 11, a section of the belt 156 is exposed at and extends across the vertical slot 136. This section of the belt 156 is engaged by a portion of the inner drum 112 to rotate the inner drum 112.

Figure 12A:
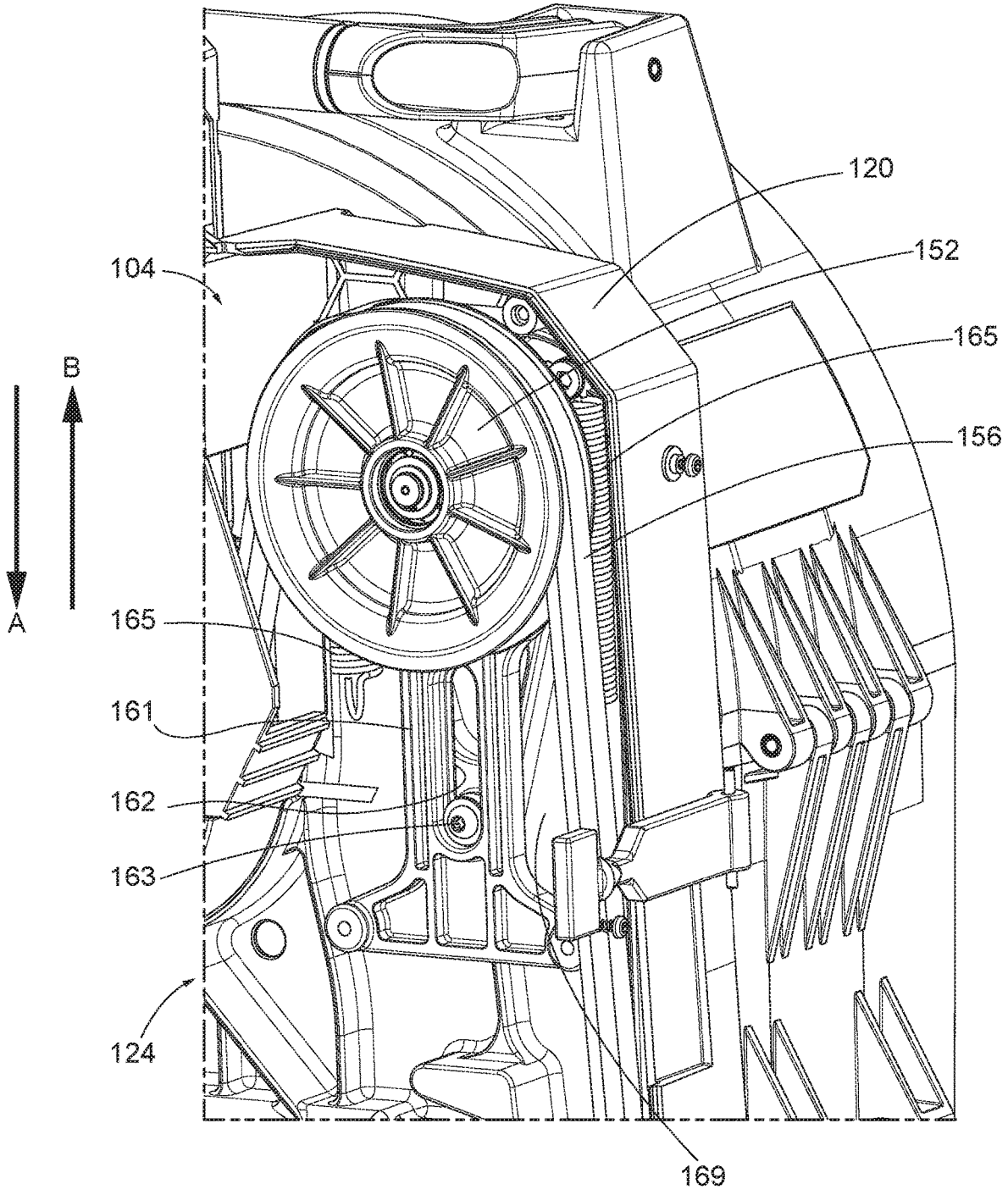
FIG. 12A is an enlarged view of a portion of the belt drive arrangement shown in FIG. 12.

As shown in FIG. 12A, the drive arrangement 124 also includes a tensioner 161 mounted to one of the idler pulleys 152. The illustrated tensioner 161 includes an elongated opening 162 that receives and rides along a boss 163 in the base unit 104. The boss 163 extends from the backbone 169 of the housing 120. The tensioner 161 is configured to allow the idler pulley 152 to move vertically relative to the housing 120. In the illustrated embodiment, the tensioner 161 is biased in the direction of arrow A (upward in FIG. 12A) by two springs 165 (e.g., coil springs). In other embodiments, the tensioner 161 may be biased by fewer or more springs. When the outer and inner drums 108, 112 are mounted to the base unit 104 at the vertical slot 136, the tensioner 161 allows the idler pulley 152 to move in the direction of arrow B (downward in FIG. 12A) to help properly tension the belt 156.

Referring back to FIG. 12, the battery receptacle 128 is formed in the housing 120. The battery receptacle 128 is configured to receive a battery pack 164, such as an 18V Li-ion power tool battery pack. The battery receptacle 128 electrically couples the battery pack 164 to the motor 170 (FIG. 24) to selectively power the motor 170. When the motor is energized by the battery pack 164, the motor 170 rotates the output shaft 160 to rotate the drive pulley 148 and, thereby, move the belt 156 about the drive arrangement 124. The motor 170 also includes a speed reducing gearbox with a plurality of gears 171.

Figure 11C:
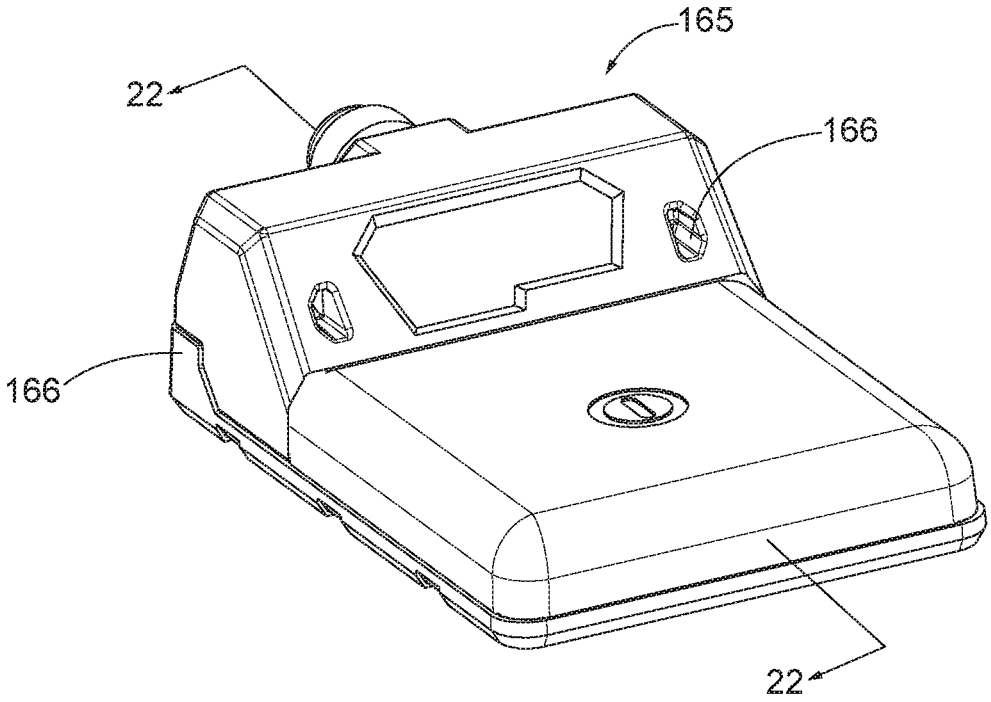
FIG. 11C is a perspective view of a foot pedal for use with the drain cleaner shown in FIG. 6.
Figure 11D:
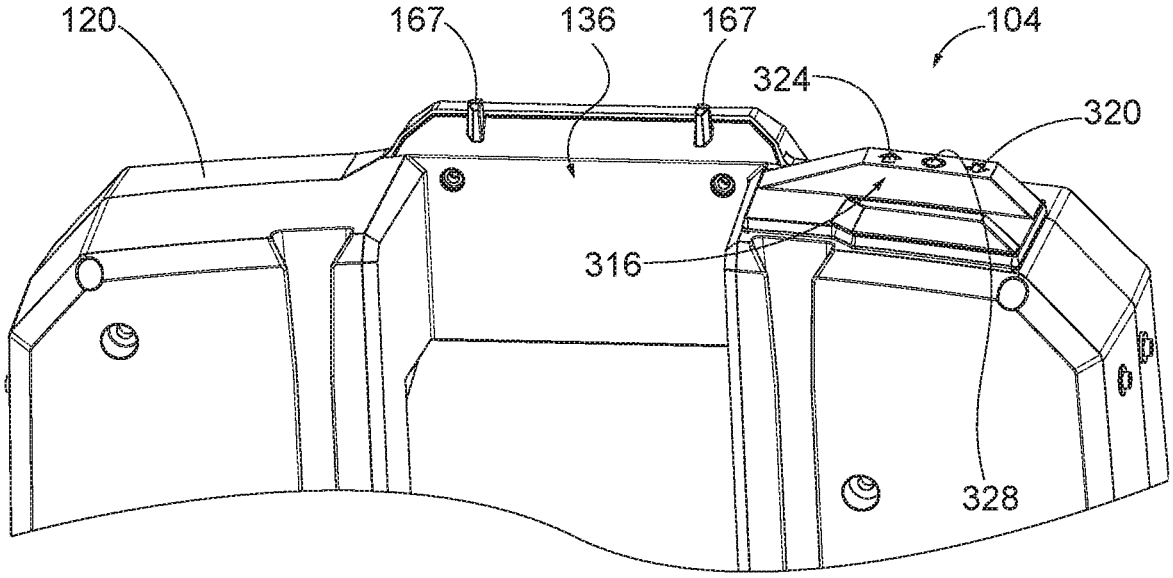
FIG. 11D is an enlarged view of a portion of the base unit shown in FIG. 11, including coupling means for connecting the foot pedal to the base unit.

The illustrated drain cleaner 100 is controlled by a foot pedal 165 (FIGS. 10 and 11). The foot pedal 165 is coupled to the battery pack 164 and the motor 170 (FIG. 24) to control the motor 170 (e.g., start and stop the motor 170). The foot pedal 165 allows a user to remotely control the motor 170 by actuating (e.g., depressing) the foot pedal 165. When not in use, the foot pedal 165 can be stored at least partially within the vertical slot 136 of the base unit 104. In particular, as shown in FIGS. 11C and 11D, the illustrated foot pedal 165 includes two inverted bosses 166, or cavities, that match two bosses 167 on the top of the base unit 104 adjacent the vertical slot 136. The inverted bosses 166 on the foot pedal 165 receive the bosses 167 of the base unit 104 to help properly align and store the foot pedal 165 in the vertical slot 136. In other embodiments, the positions of the inverted bosses 166 and the bosses 167 may be reversed, and/or the foot pedal 165 may include other coupling means for removably connecting the foot pedal 165 to the base unit 104.

As shown in FIG. 10, the illustrated base unit 104 also includes a stabilizer 168. The stabilizer 168 includes a rod member 172 and two feet 176 that are coupled to the rod member 172. In the illustrated embodiment, the rod member 172 is bent into a general U-shape. The feet 176 are coupled to corners of the U-shape. In addition, a handle 180 is coupled to the rod member 172 between the feet 176. The handle 180 helps a user grasp the stabilizer 168 to move the stabilizer 168 relative to the base unit 104. In the illustrated embodiment, the stabilizer 168 is linearly slidable into and out of the base unit 104 between a retracted position (FIG. 7) and an extended position (FIG. 10). While in the retracted position, the base unit 104 is relatively compact. While in the extended position, the base unit 104 has a larger base for stability. In particular, the stabilizer 168 creates a tripod-like support between the feet 176 and the outer drum 108. The illustrated stabilizer 168 is movable to a range of positions between the retracted position and a fully extended position to fit within different sized work areas.

Figure 10B:
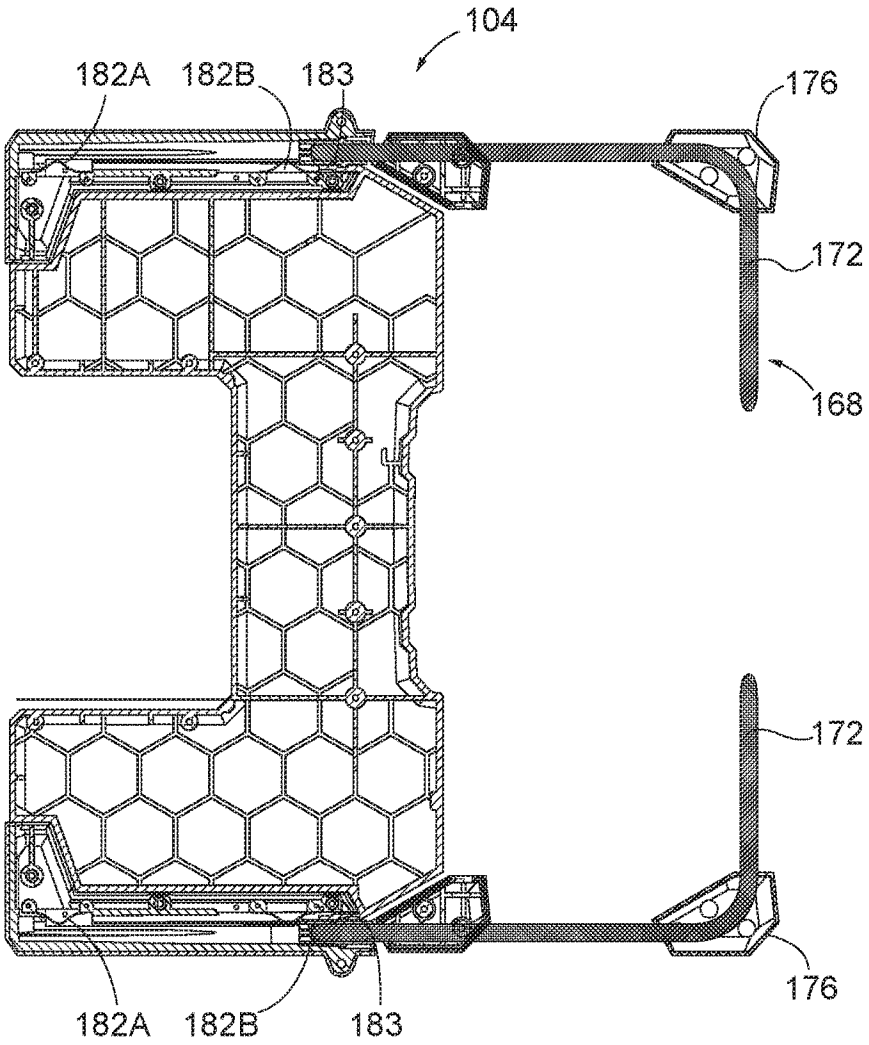
FIG. 10B is a cross-sectional view of a base portion of the drain cleaner shown in FIG. 6, illustrating the stabilizer in the extended position.
Figure 10A:
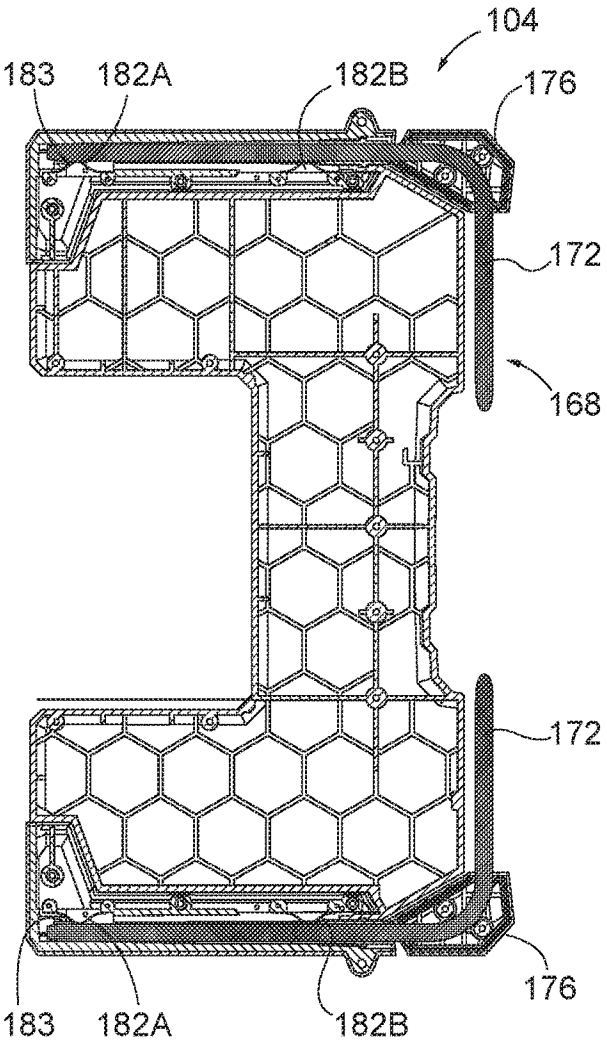
FIG. 10A is a cross-sectional view of a base portion of the drain cleaner shown in FIG. 6, illustrating the stabilizer in a retracted position.

Referring to FIGS. 10A and 10B, the base unit 104 includes a detent mechanism to retain the stabilizer 168 in the retracted position (FIG. 10A) and the fully extended position (FIG. 10B). In the illustrated embodiment, the detent mechanism includes two sets of spring members 182A, 182B supported by the base unit 104 and projections 183 coupled to the rod member 172. The illustrated projections 183 are integrally formed with the rod member 172 adjacent ends of the rod member 172. When in the retracted position, as shown in FIG. 10A, the projections 183 engage the first set of spring members 182A to inhibit the rod member 172 from freely sliding out of the base unit 104. When in the extended position, as shown in FIG. 10B, the projections 183 engage the second set of spring members 182B to inhibit the rod member 172 from freely sliding into the base unit 104. In further embodiments, the detent mechanism may include additional sets of spring members to retain the stabilizer 168 in other positions.

As shown in FIGS. 13-16, the outer drum 108 includes a clamshell housing 184 that receives the inner drum 112. The illustrated clamshell housing 184 includes a lower housing portion 188, an upper housing portion 192, a hinge 196, and a latch 200. The upper housing portion 192 is pivotally coupled to the lower housing portion 188 by the hinge 196. As such, the upper housing portion 192 is movable (e.g., pivotable) about the hinge 196 relative to the lower housing portion 188 between a closed position and an open position. When in the closed position, as illustrated, the clamshell housing 184 substantially encloses and protects the inner drum 112. When in the open position, the inner drum 112 is exposed and may be removable from the outer drum 108. The latch 200 extends between the lower and upper housing portions 188, 192 and selectively secures the upper housing portion 192 in the closed position.

Figure 16:
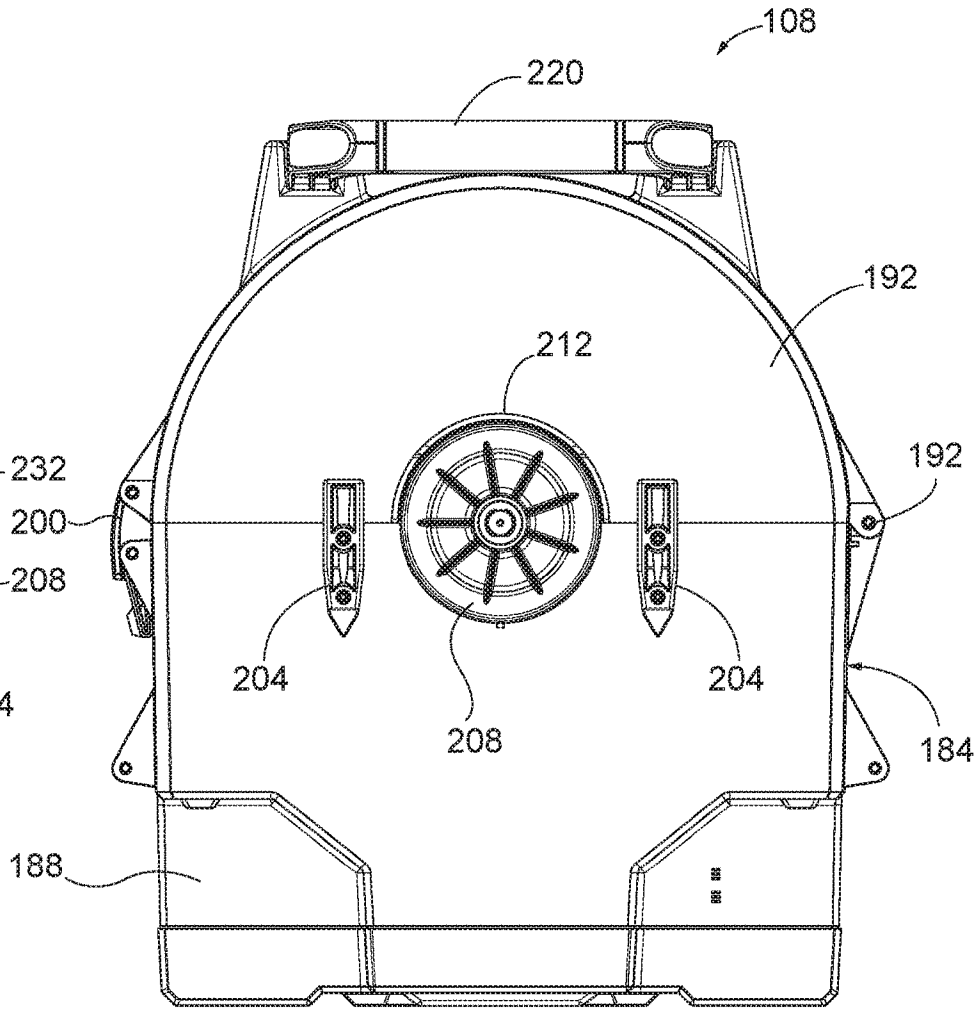
FIG. 16 is a rear view of the outer drum of FIG. 13.
Figure 15:
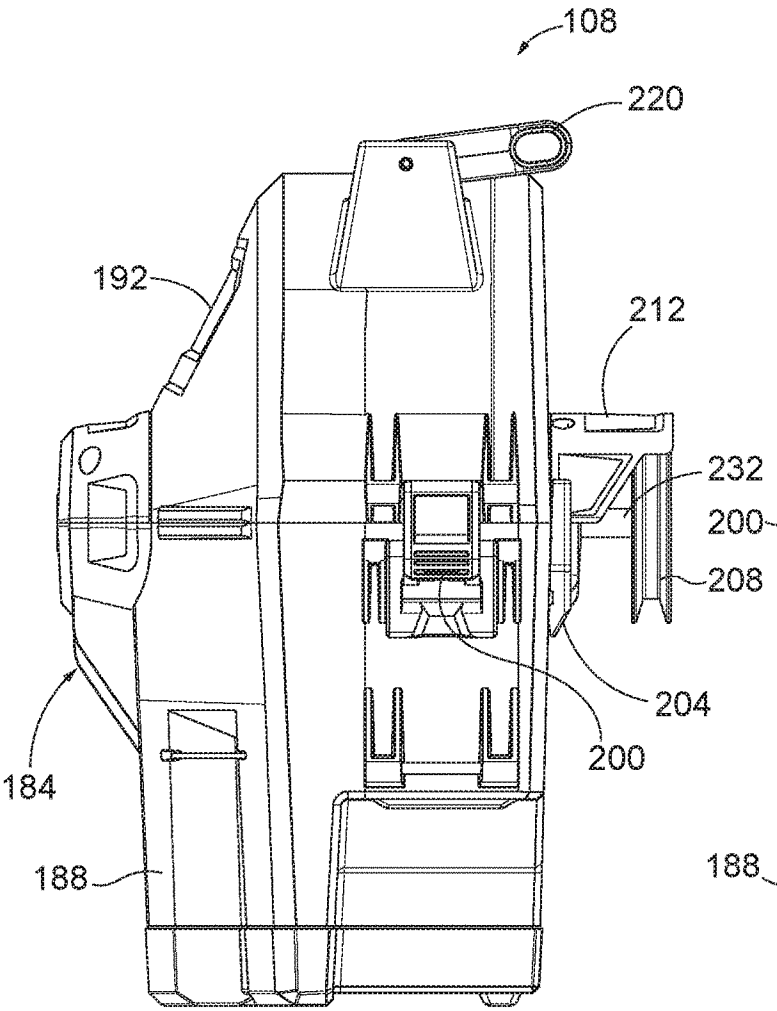
FIG. 15 is a side view of the outer drum of FIG. 13.

The outer drum 108 is selectively coupled to the base unit 104 by inserting (e.g., dropping) the outer drum 108 onto the base unit 104 from vertically above the base unit 104. Referring to FIGS. 15 and 16, the outer drum 108 includes two guide rails 204 extending from a rear of the clamshell housing 184. The guide rails 204 are configured to fit within the guide slots 140 (FIG. 11) of the base unit 104 to help align the outer drum 108 on the base unit 104. A driven pulley 208 of the inner drum 112 also extends outwardly from the rear of the clamshell housing 184. The driven pulley 208 is configured to fit within the vertical slot 136 (FIG. 11) of the base unit 104 and engage the belt 156. A shield 212 of the outer drum 108 extends over the driven pulley 208 to help cover and protect the driven pulley 208 when the driven pulley 208 is received in the vertical slot 136.

When the outer drum 108 is properly aligned and inserted onto the base unit 104, two latches 216 (FIGS. 6-8) selectively secure the outer drum 108 to the base unit 104. The latches 216 are positioned on opposing sides of the outer drum 108 and engage corresponding features on the base unit 104. In the illustrated embodiment, the latches 216 are over-center latches. In other embodiments, other coupling mechanisms may be used to secure the outer drum 108 to the base unit 104. The weight of the outer drum 108 and the securement of the latches 216 create sufficient force between the driven pulley 208 and the belt 156 (FIG. 11) to tension the belt 156 when the outer drum 108 is connected to the base unit 104.

Figure 14:
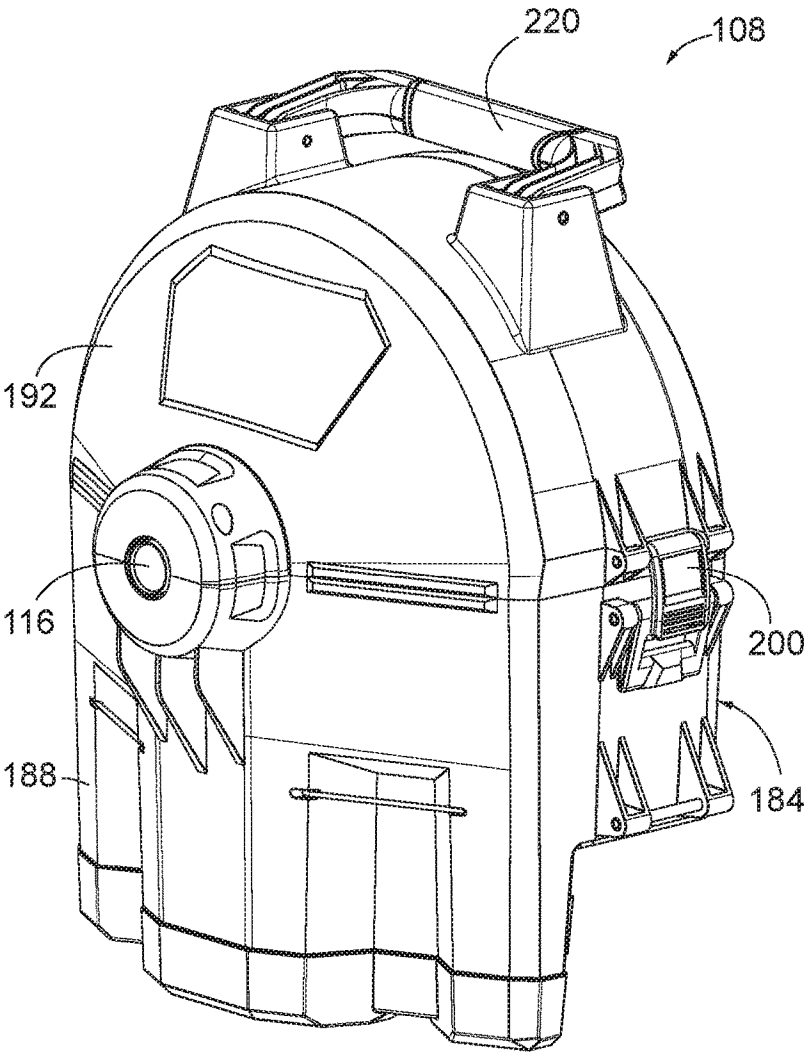
FIG. 14 is another perspective view of the outer drum of FIG. 13.
Figure 13:
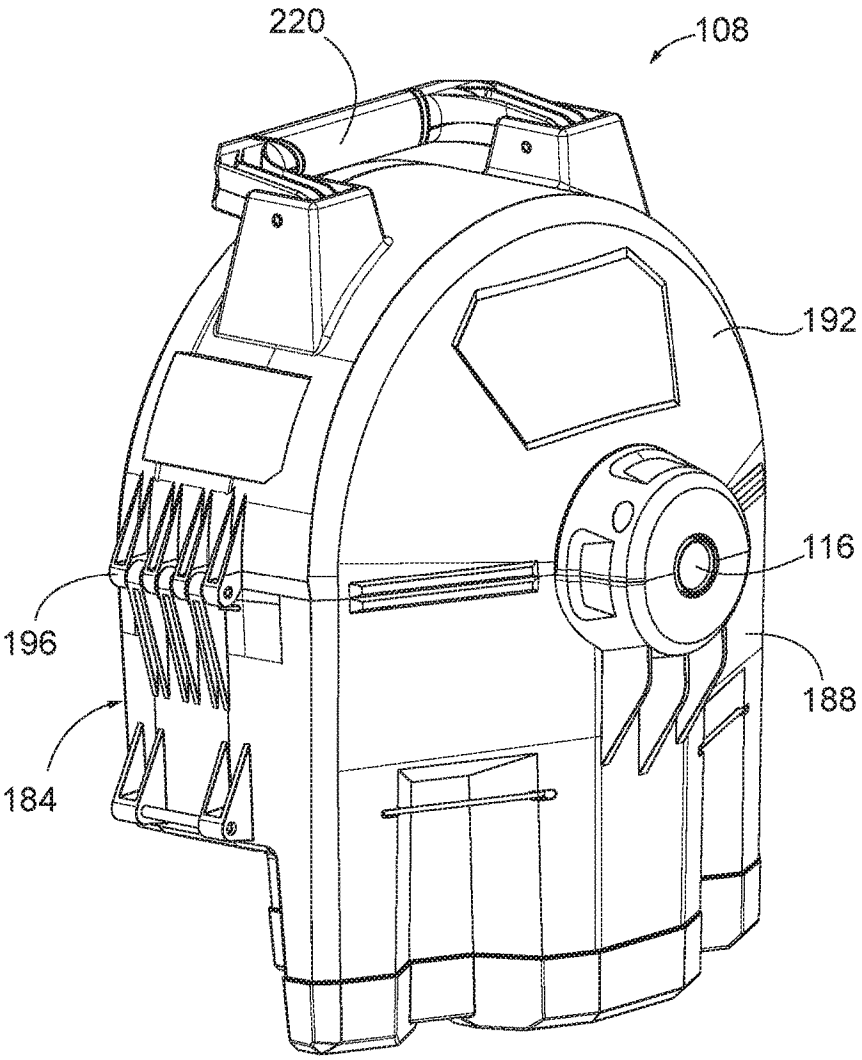
FIG. 13 is a perspective view of an outer drum of the drain cleaner shown in FIG. 6.

As shown in FIGS. 13 and 14, the outer drum 108 also includes a handle 220. The illustrated handle 220 is pivotally coupled to the upper housing portion 192. The handle 220 facilitates lifting the outer drum 108 apart from the base unit 104. The handle 220 also facilitates carrying the outer drum 108 (with the inner drum 112) apart from the base unit 104. The handle 220 further facilitates inserting the outer drum 108 onto the base unit 104. When the outer drum 108 is secured to the base unit 104 (e.g., via the latches 216), the handle 220 can also be used to lift and carry the entire drain cleaner 100.

As shown in FIGS. 17 and 18, the inner drum 112 includes a generally cylindrical housing 224, a guide conduit 228, a driven shaft 232, and the driven pulley 208. The housing 224 is configured to receive and store the flexible cable of the drain cleaner 100. In the illustrated embodiment, the housing 224 includes weep holes 236 formed in the perimeter of the housing 224. The weeps holes 236 provide drains into the outer drum 108, keeping the flexible cable from sitting in water if the inner drum 112 is not emptied. The guide conduit 228 guides the flexible cable from the housing 224 to the opening 116 (FIG. 6) in the outer drum 108.

Figure 25:
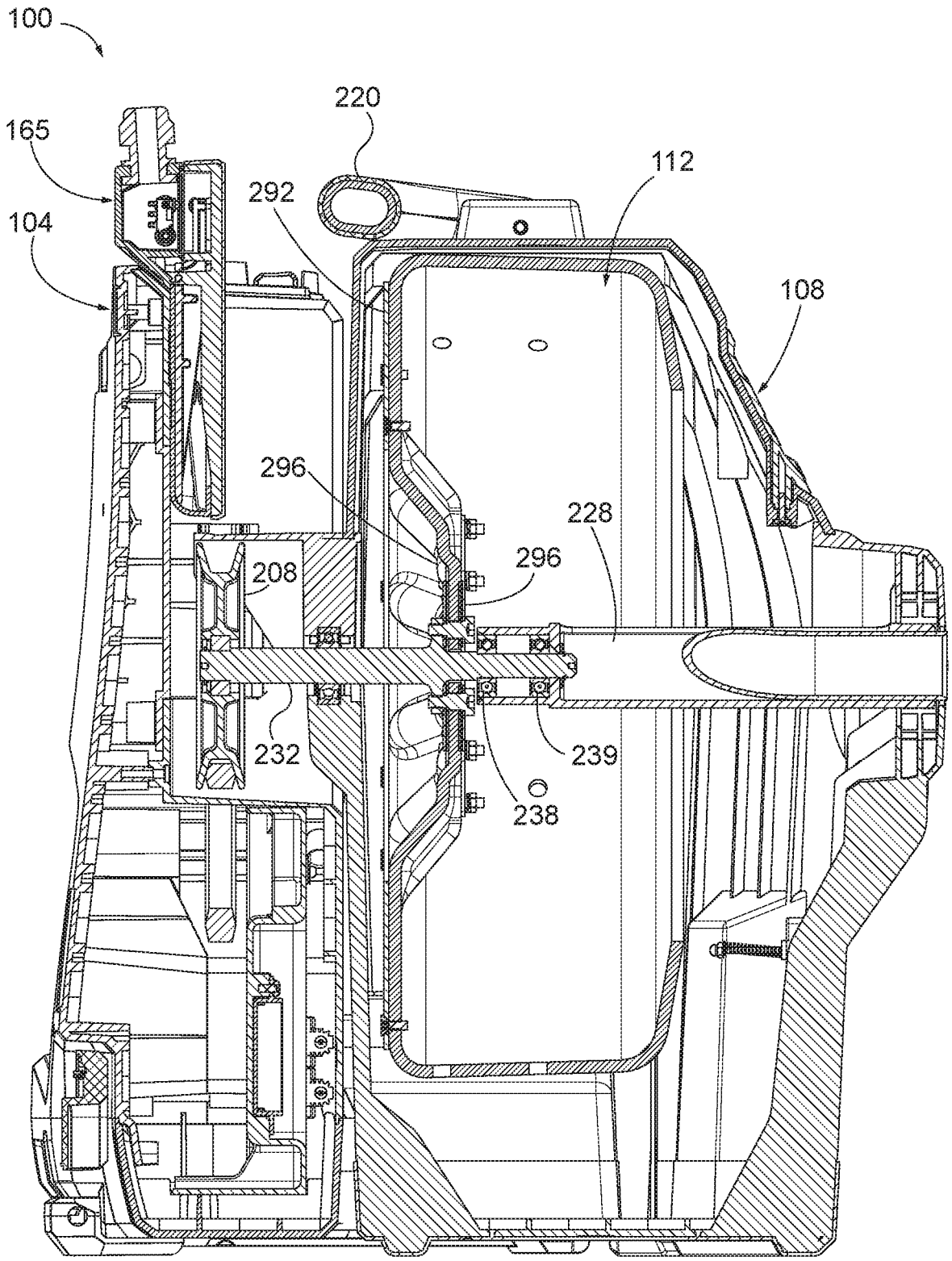
FIG. 25 is a cross-sectional view of the drain cleaner taken along section line 25-25 of FIG. 3.

As shown in FIG. 25, the driven shaft 232 is coupled to the guide conduit 228. In the illustrated embodiment, the driven shaft 232 extends through a first bearing 238 and a second bearing 239, and into the guide conduit 228. The first bearing 238 and the second bearing 239 allow the driven shaft 232 and the guide conduit 228 to support each other. The first bearing 238 and the second bearing 239 also allow the guide conduit 228 to spin independently of the housing 224 and the driven shaft 232 in order to allow the flexible cable to properly feed into or out of the housing 224.

As shown in FIG. 18, the driven shaft 232 is coupled to and extends rearwardly from the housing 224. The driven pulley 208 is coupled to a distal end of the driven shaft 232. More particularly, the driven pulley 208 is fixed to the driven shaft 232. When the driven pulley 208 is rotated by the belt 156 (FIG. 11), the driven pulley 208 rotates the driven shaft 232, which rotates the housing 224 and spins the flexible cable.

Figure 20:
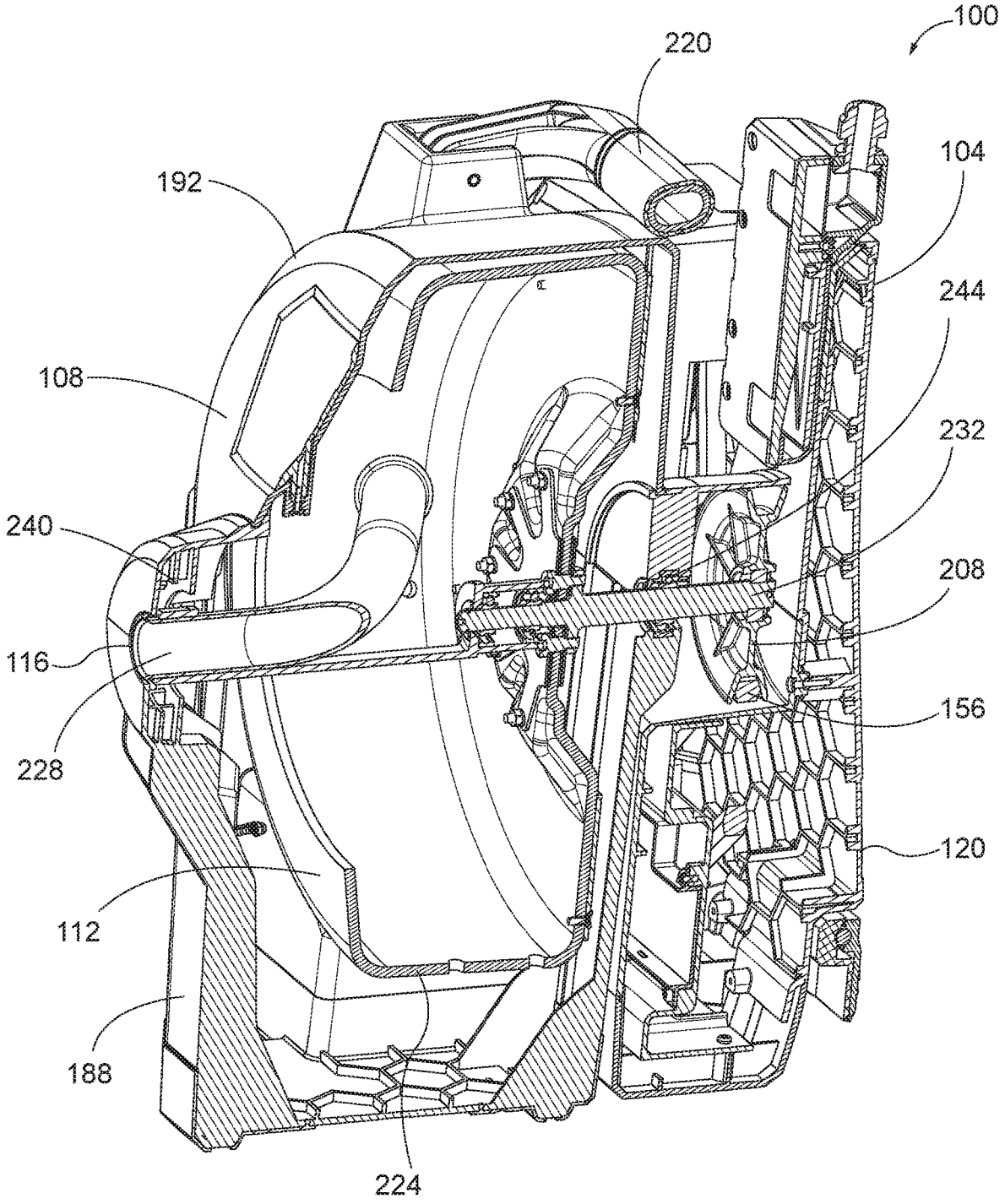
FIG. 20 is a cross-sectional view of the drain cleaner taken along section line 20-20 of FIG. 7.

In the illustrated embodiment, the inner drum 112 also includes two bearings 240, 244 that support the inner drum 112 within the outer drum 108 for rotation relative to the outer drum 108. The first bearing 240 is located on the guide conduit 228. The second bearing 244 is located on the driven shaft 232. As shown in FIG. 20, the bearings 240, 244 are located between sections of the lower housing portion 188 and the upper housing portion 192 of the clamshell housing 184 when the outer drum 108 is closed. In the illustrated embodiment, each bearing 240, 244 is secured to the lower housing portion 188 by a bearing clamp that keeps the inner drum 112 connected to the lower housing portion 188 when the outer drum 108 is opened. When the outer drum 108 is opened, the inner drum 112 can be removed from the outer drum 108 (by also removing the bearing clamps), facilitating cleaning of the inner drum 112 and the outer drum 108.

Figure 19:
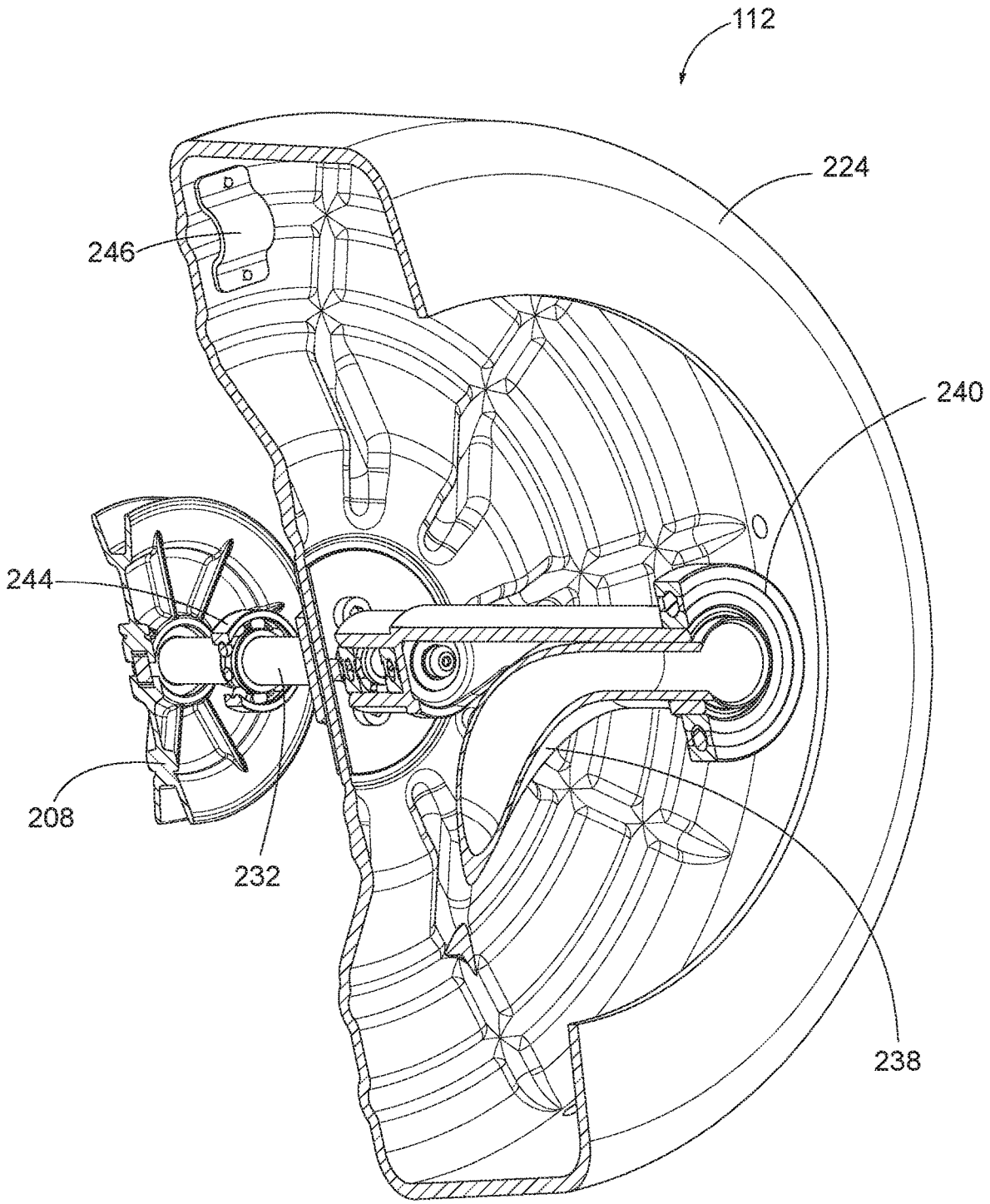
FIG. 19 is a cross-sectional view of the inner drum of FIG. 17 taken along section line 19-19 of FIG. 17.

As shown in FIG. 19, the inner drum 112 also includes a securement member 246 coupled to an inner surface of the drum 112. In the illustrated embodiment, the securement member 246 is a metal stamping formed as a U-shaped bracket. The illustrated securement member 246 is secured to the drum 112 by threaded fasteners. The securement member 246 provides a connection point for securing the flexible cable to the inner drum 112. More particularly, the securement member 246 engages a leader cable having a connector at its distal end. The connector is configured to attach to a proximal end of another flexible cable that is inserted into the drain, allowing a user to detach an "effective" cable from the drum 112 without opening the drum 112 or sticking one's hands inside the drum 112. For example, in some embodiments, the leader cable may be about three feet in length. In other embodiments, the leader cable may be longer or shorter.

Referring back to FIG. 20, the outer drum 108 and the inner drum 112 (collectively, "the drum assembly" or "the drum unit") are connected to the base unit 104. In this condition, the driven pulley 208 of the inner drum 112 is received in the vertical slot 136 of the base unit 104 so the inner drum 112 engages the belt 156 of the drive arrangement 124. The weight of the drum unit on the belt 156 tensions the belt 156 so movement (e.g., rotation) of the belt 156 also drives the driven pulley 208 and, thereby, the inner drum 112. In the illustrated embodiment, the belt 156 is rotated by selectively energizing the motor 170 (FIG. 24) with the battery pack 164 to drive the drive arrangement 124. As the inner drum 112 rotates, the flexible cable stored within the inner drum 112 is also rotated or spun. A user can feed the flexible cable into or out of the drum unit by manually pushing/pulling the flexible cable or by using a suitable feed mechanism coupled to the cable.

Figure 21:
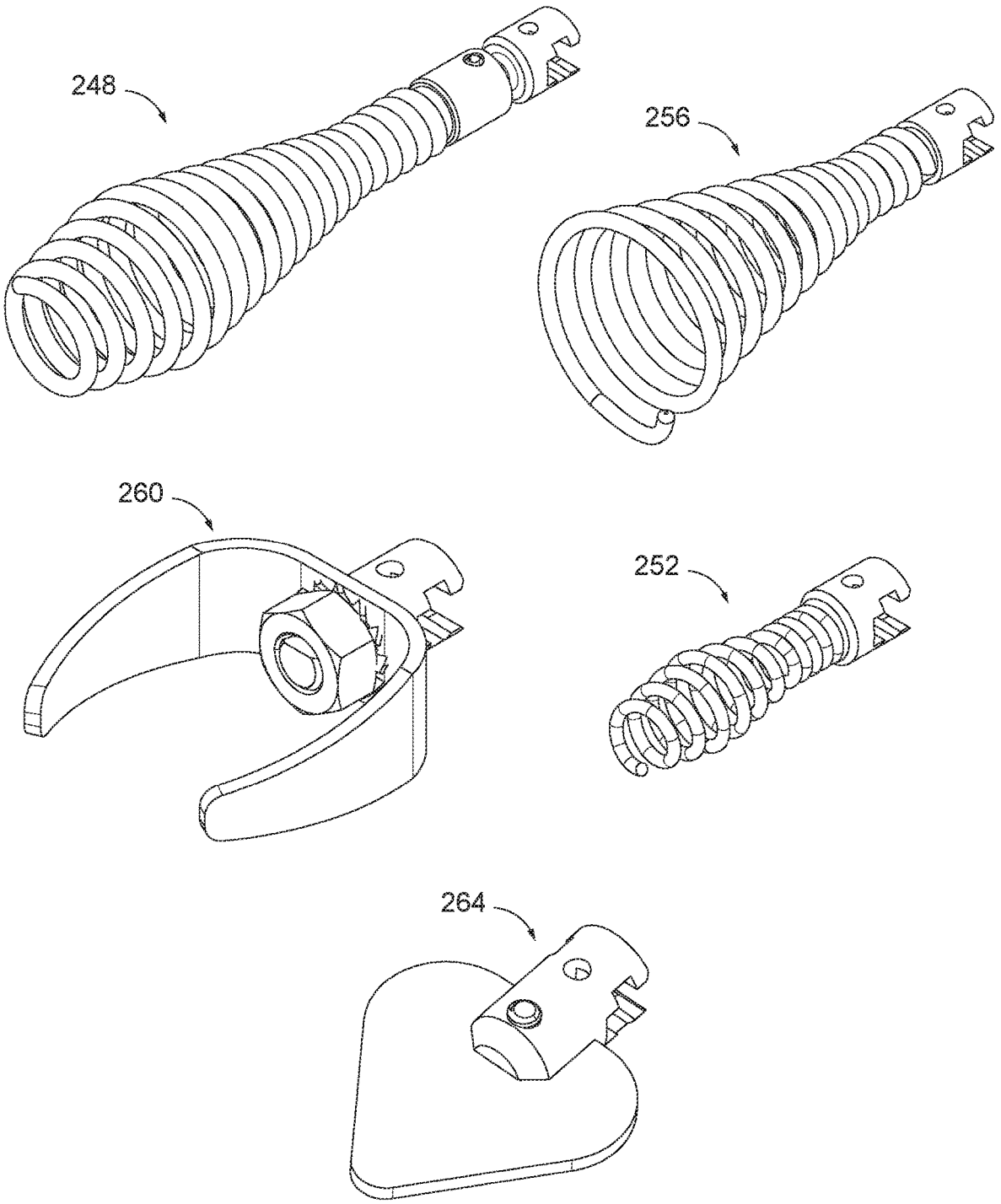
FIG. 21 illustrates a variety of cable attachments for use with the drain cleaner shown in FIG. 6.

FIG. 21 illustrates a variety of attachments that can be coupled to an end of the flexible cable. The attachments are tools that can be inserted into a drain with the flexible cable to help clean the drain. The illustrated attachments include a large drop head 248, a smaller drop head 252, a bulb head 256, a C-shaped cutter 260, and a spade-shaped cutter 264. Other types of attachments may also or alternatively be connected to the flexible cable.

Figure 22:
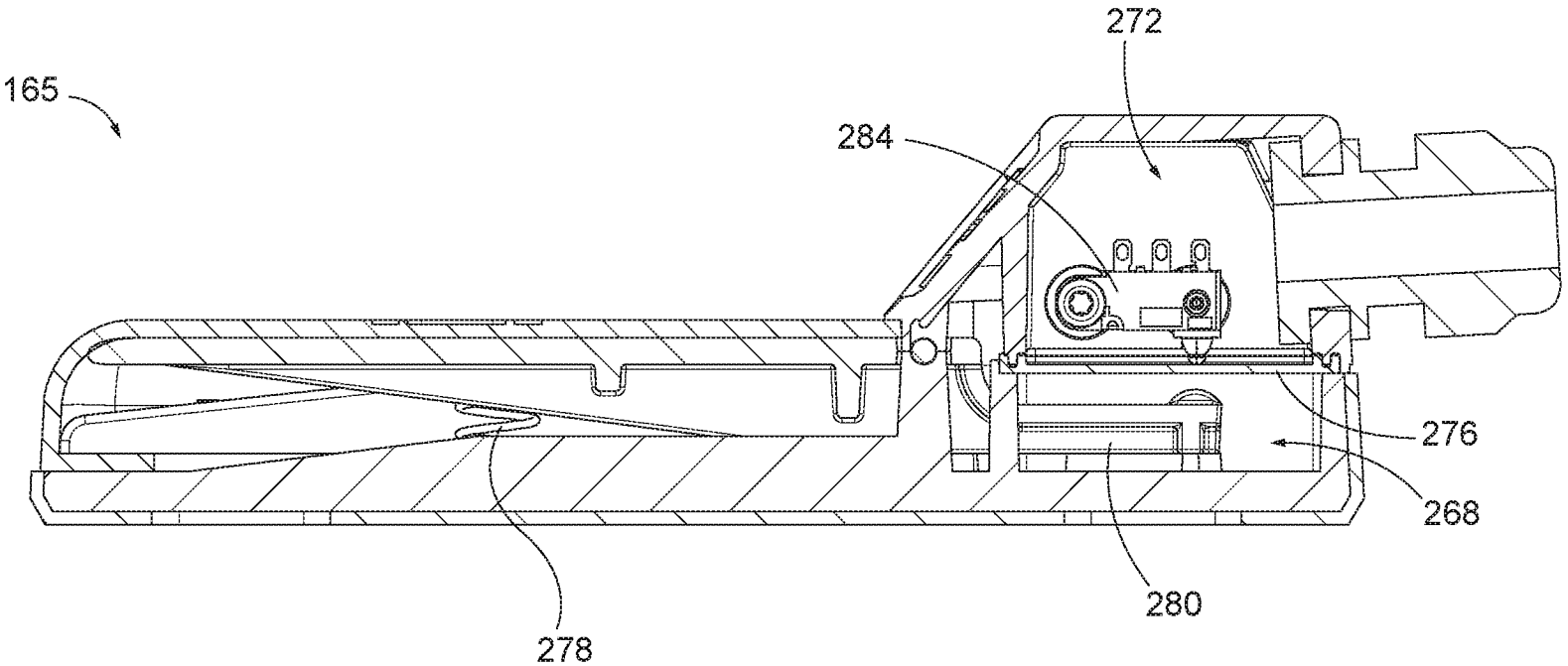
FIG. 22 is a cross-sectional view of the foot pedal taken along section line 22-22 of FIG. 11C.

As shown in FIG. 22, the foot pedal 165 includes a first cavity 268 and a second or sealed cavity 272. In the illustrated embodiment, a separator or sealing member 276 is positioned between the first cavity 268 and the sealed cavity 272. The sealing member 276 is made from a flexible material (e.g., rubber) and limits liquids from entering the sealed compartment 272 from the first compartment 268 or an external environment. An actuation lever 280 is positioned within the first cavity 268 and is aligned with a switch 284 positioned within the sealed cavity 272. In the illustrated embodiment, the switch 284 is positioned adjacent to the sealing sheet 276, while the actuation lever 280 is spaced apart from the sealing sheet 276. User input to the foot pedal 165 compresses a spring 278 and pivots the actuation lever 280 toward the sealed cavity 272. The sealing sheet 276 flexes and allows the actuation lever 280 to engage the switch 284 through the sealing sheet 276 to selectively power the drain cleaner 100. The spring 278 returns the actuation lever 280 to an initial position (FIG. 22) when the user ceases to provide an input.

Before actuating the foot pedal 165, the user may actuate a button on a feed switch 316 positioned on the base unit 104 proximate the vertical slot 136 (FIG. 11D). In the illustrated embodiment, the feed switch 316 includes three distinct buttons. A first or feed button 320 (FIG. 11D) may be selected to operate the motor 170 (FIG. 24) in a clockwise direction and feed the cable out of the outer drum 108. A second or retract button 324 (FIG. 11D) may be selected to operate the motor 170 in a counter clockwise direction and retract the extended cable back within the outer drum 108. A third or neutral button 328 (FIG. 11D) may be selected so that the motor 170 is not operated. Each of the buttons 320, 324, 328 of the feed switch 316 is monitored with a microcontroller (not shown) and electrically connected in series with an electrical signal from the foot pedal 165. Signal level current, not motor current, passes through the contacts of the feed switch 316.

When the neutral button 328 is actuated, the signal from the foot pedal 165 is decoupled from a microcontroller input. In other words, actuating the foot pedal 165 while the neutral button 328 is pressed will not operate the motor 170. Furthermore, if either the feed button 320 or the retract button 324 are toggled to from the neutral button 328 while the foot pedal 165 is actuated, the motor 170 will not operate. The user must release the foot pedal 165 before selecting a different button 320, 324 in order for the actuation of the foot pedal 165 to result the microcontroller receiving a new input signal.

Additionally, if a user toggles between the feed button 320 and the retract button 324 while the foot pedal 165 is actuated, the microcontroller will stop operating the motor 170. Similar to toggling off of the neutral button 328, the user must release the foot pedal 165 and reselect the desired button (i.e., the feed button 320 or the retract button 324) before reactuating the foot pedal 165.

Figure 23:
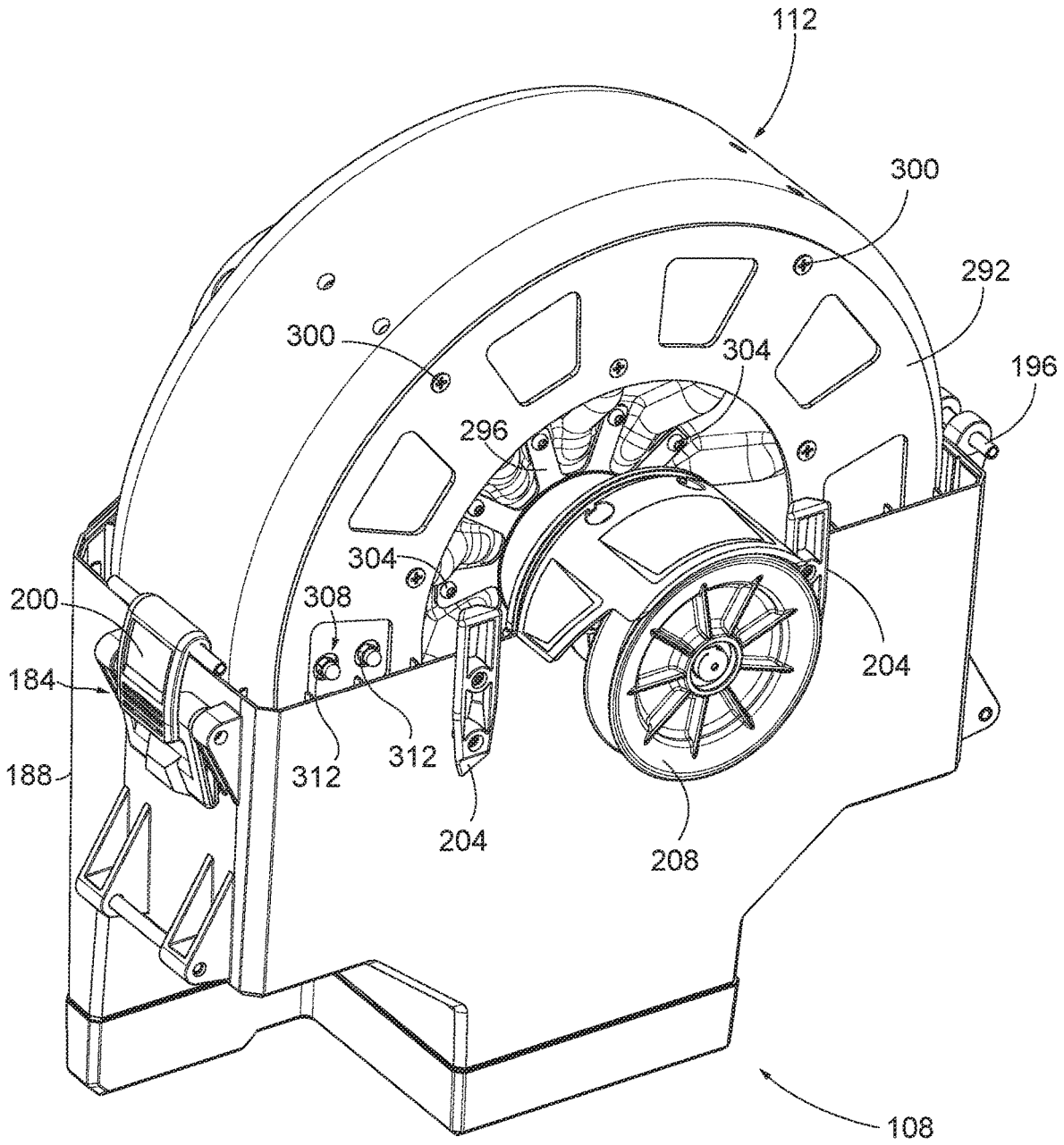
FIG. 23 is a perspective view of the inner drum inside of the outer drum.

As shown in FIGS. 23 and 24, the inner drum 112 includes an outer reinforcement plate 292 and inner reinforcement plates 296, although in other embodiments, the inner drum 112 may include only one reinforcement plate 292, 296 or no reinforcement plates. In the illustrated embodiment, the reinforcement plates 292, 296 are made from metal, while the inner drum 112 is made from a less hard material, such as plastic. The outer reinforcement plate 292 is coupled to an outer surface of the inner drum 112 proximate the driven pulley 208 via fastening members 300 (e.g., self-tapping screws). The inner reinforcement plates 296 are coupled to either side of an inner surface of the inner drum 112 proximate the driven shaft 232 (FIG. 25) via a plurality of fastening members 304 (e.g., screws, nuts, and star washers). The reinforcement plates 292, 296 provide additional strength to the inner drum 112 in order to limit deflection to the inner drum 112 caused by cables during operation. In the illustrated embodiment, the inner drum 112 is made from plastic and over time, the friction between the cables and a surface of the inner drum 112 may wear through the inner drum 112. The reinforcement plates 292, 296 guard against wear caused by the cables in order to protect the surface of the inner drum 112.

Figure 23B:
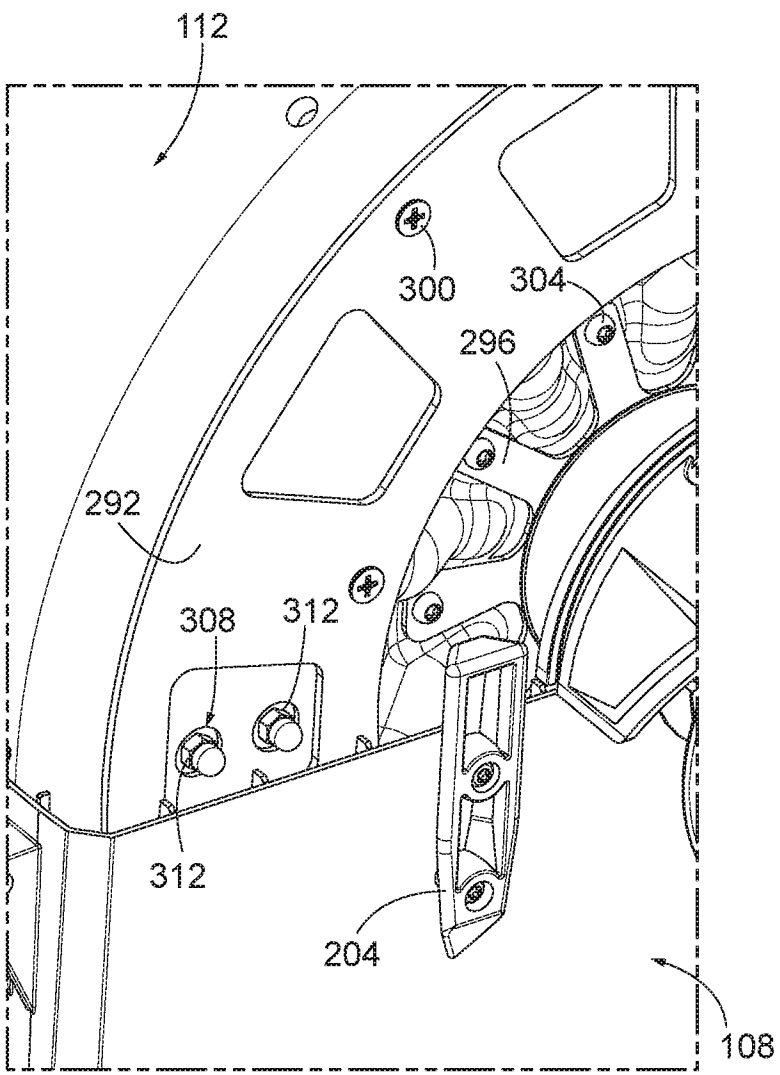
FIG. 23B is an enlarged view of the inner drum from FIG. 23 illustrating the securement member.
Figure 23A:
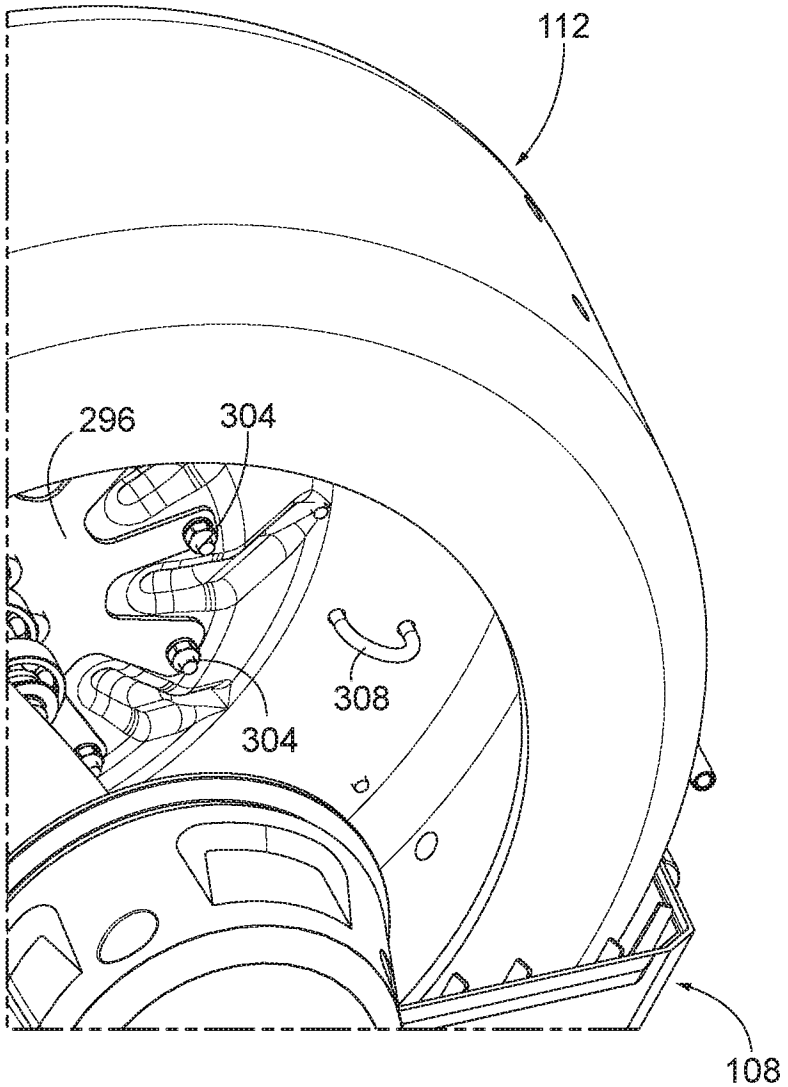
FIG. 23A is an enlarged view of the inner drum from of FIG. 23 illustrating a securement member.

As shown in FIGS. 23A and 23B, the inner drum 112 includes an alternate embodiment of a securement clamp 308. In the illustrated embodiment, the securement clamp 308 is a U-bolt. The cable clamp 308 extends through the inner surface of the inner drum 112 so that a curved portion of the U-bolt 308 is proximate the first bearing 240. Cap nuts 312 couple to the U-bolt 308 proximate the outer reinforcement plate 292. Similar to the securement member 246, the U-bolt 308 engages a leader cable having a connector at its distal end. The connector is configured to attach to a proximal end of another flexible cable that is inserted into the drain, allowing a user to detach an "effective" cable from the drum 112 without opening the drum 112 or sticking one's hands inside the drum 112.

Although aspects have been described in detail with reference to certain preferred embodiments, variations and modifications exist within the scope of one or more independent aspects as described. Various features and advantages of the invention are set forth in the following claims.

What is claimed is:

1. A drain cleaner comprising:

a base unit including a housing, a drive arrangement positioned within the housing, and a motor coupled to the drive arrangement and supported by the housing, the motor operable to selectively drive the drive arrangement; and a drum unit removably coupled to the base unit, the drum unit including a drum that engages the drive arrangement when the drum unit is coupled to the base unit to rotate the drum, and a cable stored within the drum and selectively extendable out of the drum and into a drain;

wherein the drum unit includes an outer casing, wherein the drum is an inner drum rotatable within the outer casing, and wherein the cable supported by the inner drum;

wherein the drum unit further includes a shaft and a pulley coupled to the inner drum, and wherein the shaft and the pulley extend out of the outer casing; and wherein the drive arrangement includes a drive pulley coupled to an output shaft of the motor, an idler pulley supported by a mounting plate of the housing, and a belt wrapped around the drive pulley and the idler pulley, and wherein the pulley of the drum unit engages the belt when the drum unit is coupled to the base unit to rotate the inner drum.

2. The drain cleaner of claim 1, wherein the base unit includes a strap arrangement coupled to the housing, wherein the strap arrangement is configured to be worn by a user.

3. The drain cleaner of claim 2, wherein the drum unit includes a handle coupled to the drum, wherein the handle is configured to be held by the user to separately carry the base unit and the drum unit.

4. The drain cleaner of claim 1, further comprising a battery pack removably coupled to the base unit, wherein the battery pack provides power to the motor.

5. The drain cleaner of claim 1, wherein the base unit further includes a stabilizer configured to support the base unit in an upright position, and wherein the stabilizer is movable between a first position, in which the stabilizer is retracted relative to the housing, and a second position, in which the stabilizer extends outward relative to the housing.

6. The drain cleaner of claim 5, wherein the stabilizer includes a rod member having a U-shape and a handle coupled to the rod member, wherein in the first position the rod member is received in the housing of the base unit, and wherein in the second position the rod member is at least partially withdrawn from the housing of the base unit.

7. The drain cleaner of claim 1, wherein the base unit further includes a vertical slot formed in the housing, wherein the belt extends across the vertical slot, and wherein the pulley of the drum unit is received in the vertical slot when the drum unit is coupled to the base unit to engage the belt.

8. The drain cleaner of claim 7, wherein the drive arrangement includes a tensioner mounted to the idler pulley, wherein the tensioner defines an elongated slot that receives a projection extending from the mounting plate of the housing, and wherein the tensioner is movable along the projection to adjust a position of the idler pulley due to a weight of the drum unit when the pulley of the drum unit engages the belt.

9. The drain cleaner of claim 8, wherein the drive arrangement further includes a spring coupled to the tensioner, wherein the spring biases the tensioner in a first direction, and wherein the weight of the drum unit pushes the tensioner in a second direction opposite the first direction.

10. The drain cleaner of claim 1, further comprising a foot pedal coupled to the base unit, and wherein the foot pedal is actuatable to control operation of the motor.

11. The drain cleaner of claim 10, wherein the foot pedal includes a switch positioned within an internal cavity, an actuation lever operable to selectively engage the switch, and a sealing member positioned between the actuation lever and the switch, wherein in response to actuation of the foot pedal, the actuation lever engages the switch through the sealing member.

12. The drain cleaner of claim 1, wherein the drum includes one selected from the group consisting of a first reinforcement plate coupled to an outer surface of the drum, a second reinforcement plate coupled to an inner surface of the drum, or both the first reinforcement plate coupled to the outer surface of the drum and the second reinforcement plate coupled to the inner surface of the drum.

13. The drain cleaner of claim 1, wherein the drum unit includes a guide conduit receiving the cable and a driven shaft received within the drum, wherein the driven shaft is coupled to the guide conduit by a first bearing and a second bearing, and wherein the first bearing and the second bearing allow the driven shaft and the guide conduit to spin independently.

14. The drain cleaner of claim 1, wherein the base unit further includes a switch with a first button, a second button, and a third button, wherein actuating the first button allows the motor to rotate in a first direction, wherein actuating the second button allows the motor to rotate in a second direction, and wherein actuating the third button prevents the motor from rotating.

15. A drain cleaner comprising:

a base unit including
- a housing defining a vertical slot,
- a motor supported by the housing and having an output shaft, and
- a drive arrangement including a drive pulley coupled to the output shaft of the motor, an idler pulley supported by the housing, and a belt wrapped around the drive pulley and the idler pulley and extending across the vertical slot; and a drum unit removably coupled to the base unit, the drum unit including
- a drum,
- a pulley coupled to the drum, the pulley being removably received in the vertical slot to engage the belt, and
- a cable stored within the drum and selectively extendable out of the drum and into a drain.

16. The drain cleaner of claim 15, further comprising a foot pedal coupled to the base unit, wherein the foot pedal is actuatable to control operation of the motor, and wherein the foot pedal is removably received in the vertical slot for storage.

17. The drain cleaner of claim 16, wherein the housing includes a boss extending into the vertical slot and the foot pedal defines a cavity, and wherein the cavity receives the boss to couple the foot pedal to the drum unit for storage.

18. The drain cleaner of claim 15, wherein the drive arrangement further includes a tensioner mounted to the idler pulley and defining an elongated slot, the elongated slot receiving a projection extending from the housing, and a spring coupled to the tensioner to bias the tensioner in a first direction, wherein when the pulley of the drum unit is received in the vertical slot, a weight of the drum unit pushes the tensioner in a second direction opposite the first direction to move the tensioner along the projection and adjust a position of the idler pulley.

19. A drain cleaner comprising:

a base unit including
- a housing defining a vertical slot,
- a strap arrangement coupled to the housing,
- a motor supported by the housing and having an output shaft,
- a battery pack supported by the housing and operable to provide power to the motor,
- a drive arrangement including a drive pulley coupled to the output shaft of the motor, an idler pulley supported by the housing, and a belt wrapped around the drive pulley and the idler pulley and extending across the vertical slot, and
- a stabilizer configured to support the base unit in an upright position, the stabilizer being movable between a first position, in which the stabilizer is retracted relative to the housing, and a second position, in which the stabilizer extends outward relative to the housing; and a drum unit removably coupled to the base unit, the drum unit including
- an outer casing,
- a handle coupled to the outer casing,
- an inner drum rotatable within the outer casing,
- a shaft coupled to the inner drum and extending out of the outer casing,
- a pulley coupled to an end of the shaft, the pulley being removably received in the vertical slot to engage the belt, and
- a cable stored within the drum and selectively extendable out of the drum and into a drain, wherein the strap arrangement is configured to be worn by a user and the handle is configured to be held by the user to separately carry the base unit and the drum unit.

20. A drain cleaner comprising:

a base unit including a housing, a drive arrangement positioned within the housing, and a motor coupled to the drive arrangement and supported by the housing, the motor operable to selectively drive the drive arrangement; and a drum unit removably coupled to the base unit, the drum unit including
- a drum that engages the drive arrangement when the drum unit is coupled to the base unit to rotate the drum, and
- a cable stored within the drum and selectively extendable out of the drum and into a drain;

wherein the base unit further includes a stabilizer configured to support the base unit in an upright position, and wherein the stabilizer is movable between a first position, in which the stabilizer is retracted relative to the housing, and a second position, in which the stabilizer extends outward relative to the housing; and wherein the stabilizer includes a rod member having a U-shape and a handle coupled to the rod member, wherein in the first position the rod member is received in the housing of the base unit, and wherein in the second position the rod member is at least partially withdrawn from the housing of the base unit.

21. A drain cleaner comprising:

a base unit including a housing, a drive arrangement positioned within the housing, and a motor coupled to the drive arrangement and supported by the housing, the motor operable to selectively drive the drive arrangement;

a drum unit removably coupled to the base unit, the drum unit including a drum that engages the drive arrangement when the drum unit is coupled to the base unit to rotate the drum, and a cable stored within the drum and selectively extendable out of the drum and into a drain; and a foot pedal coupled to the base unit, wherein the foot pedal is actuatable to control operation of the motor;

wherein the foot pedal includes a switch positioned within an internal cavity, an actuation lever operable to selectively engage the switch, and a sealing member positioned between the actuation lever and the switch, wherein in response to actuation of the foot pedal, the actuation lever engages the switch through the sealing member.

22. A drain cleaner comprising:

a base unit including a housing, a drive arrangement positioned within the housing, and a motor coupled to the drive arrangement and supported by the housing, the motor operable to selectively drive the drive arrangement; and a drum unit removably coupled to the base unit, the drum unit including a drum that engages the drive arrangement when the drum unit is coupled to the base unit to rotate the drum, and a cable stored within the drum and selectively extendable out of the drum and into a drain; and wherein the drum unit includes a guide conduit receiving the cable and a driven shaft received within the drum, wherein the driven shaft is coupled to the guide conduit by a first bearing and a second bearing, and wherein the first bearing and the second bearing allow the driven shaft and the guide conduit to spin independently.

23. A drain cleaner comprising:

a base unit including a housing, a drive arrangement positioned within the housing, and a motor coupled to the drive arrangement and supported by the housing, the motor operable to selectively drive the drive arrangement; and a drum unit removably coupled to the base unit, the drum unit including a drum that engages the drive arrangement when the drum unit is coupled to the base unit to rotate the drum, and a cable stored within the drum and selectively extendable out of the drum and into a drain; and wherein the base unit further includes a switch with a first button, a second button, and a third button, wherein actuating the first button allows the motor to rotate in a first direction, wherein actuating the second button allows the motor to rotate in a second direction, and wherein actuating the third button prevents the motor from rotating.

* * * * *